US005805960A

United States Patent [19]

Suzuki et al.

[11] Patent Number: 5,805,960

[45] Date of Patent: Sep. 8, 1998

[54] IMAGE FORMING APPARATUS WHICH APPLIES OSCILLATING VOLTAGE TO DEVELOPER CARRYING MEMBER

[75] Inventors: Hiroyuki Suzuki, Yokohama; Masahiro Itoh, Odawara; Kenichiro Waki, Kawasaki; Ryo Inoue, Musashino, all of Japan

[73] Assignee: Canon Kabushiki Kaisha, Tokyo, Japan

[21] Appl. No.: 489,171

[22] Filed: Jun. 9, 1995

[30] Foreign Application Priority Data

Jun. 9, 1994 [JP] Japan ..... 6-127837
Feb. 21, 1995 [JP] Japan ..... 7-032394

[51] Int. Cl.[6] ..... G03G 15/22; G03G 15/24

[52] U.S. Cl. ..... 399/149; 399/148

[58] Field of Search ..... 355/269, 270, 355/246, 251; 118/653, 652; 399/148, 149, 50, 264

[56] References Cited

U.S. PATENT DOCUMENTS 4,627,703 12/1986 Suzuki et al. ..... 355/271
4,769,676 9/1988 Mukai et al. ..... 118/652 X
5,148,219 9/1992 Kohyama ..... 355/269 X
5,177,536 1/1993 Watanabe et al. ..... 355/251
5,221,946 6/1993 Kohyama ..... 355/270
5,249,022 9/1993 Watanabe et al. ..... 355/271
5,267,007 11/1993 Watanabe et al. ..... 355/245
5,294,967 3/1994 Munakata et al. ..... 355/326 R
5,424,812 6/1995 Kemmochi et al. ..... 355/251
5,438,394 8/1995 Suzuki et al. ..... 355/251

*Primary Examiner*—Matthew S. Smith
*Attorney, Agent, or Firm*—Fitzpatrick, Cella, Harper & Scinto

[57] ABSTRACT

An image forming apparatus includes an electrostatic image bearing member for bearing an electrostatic image; a developer carrying member for carrying developer containing toner; a voltage source for applying to said developer carrying member, an oscillating voltage of a predetermined frequency: a toner image forming device for forming a toner image on said electrostatic image bearing member using said voltage source; a transferring device for transferring the toner image onto transfer material; and a removing device for removing, using said voltage source, the toner remaining on said electrostatic image bearing member after the use of said transferring device: the voltage satisfies:

$$\frac{|Vpp - 2V\text{back}|}{16\,Vf^2} < \frac{d^2}{|Q|} \text{ and } Vpp/d > 2 \times 10^6\ (V/m)$$

$V_{pp}$ [V]: peak-to-peak voltage of oscillating voltage $V_f$ [Hz]: frequency of oscillating voltage $V_{back}$ [V]: potential difference between surface potential of electrostatic image bearing member and DC component of oscillating voltage Q [c/kg]: average amount of toner charge d [m]: shortest distance between electrostatic image bearing member and developer carrying member.

20 Claims, 10 Drawing Sheets

IMAGE FORMING APPARATUS WHICH APPLIES OSCILLATING VOLTAGE TO DEVELOPER CARRYING MEMBER

FIELD OF THE INVENTION AND RELATED ART

The present invention relates to an image forming apparatus, such as a copying machine or a printer and, in particular to, an image forming apparatus in which developing means can double as means for cleaning an electrostatic image bearing member.

In recent years, copying machines have been enabled to produce color prints, and also, systematized. Subsequently, digitization of the printer has been in progress.

For example, an apparatus such as a laser printer has come to be widely known that records a desired image with the use of a scanning laser beam which forms a latent image on a photosensitive drum as it is turned on an off. Such an apparatus is used typically in the binary recording of letters and figures. Since recording of characters and figures does not require half tone, the printer structure can be simplified. There are also such printers capable of producing a half tone image while employing the binary recording system. As for such printers, those employing the dithering method, density pattern method, or the like are well-known. However, as is widely known, it is impossible to obtain a high resolution image using a printer which employs the dither or density pattern method. Therefore, a method has been proposed which forms a half tone picture element without reducing recording density. According to this method, the half tone is produced by modulating the laser beam pulse width with an image signal, resulting in an image with high resolution and superior gradation.

Next, a conventional image forming apparatus illustrated in FIG. 2 will be briefly described.

First, an original G is placed on an original table 10, with the surface to be copied facing downward. Next, a copy button is pressed to start copying. The original is scanned by a light beam from an integrated unit 9 comprising an original illuminating lamp, a short focus lens array, and a CCD sensor. The scanning light reflected by the original surface is focused by the short focus lens array, projected onto the CCD sensor which comprises a light receiving section, a transfer section, and an output section. In the CCD section, the light signal is converted into an electric signal, which is sequentially transferred to the output section in synchronism with a clock pulse, through the transfer section. In the output section, a charge signal is converted into a voltage signal, which is outputted at a low impedance, after being amplified. An analog signal thus obtained is subjected to the well-known imaging process, thereby being thereby converted into a digital signal, which is sent to a printing section. The printing section having received the image signal forms an electrostatic latent image in the following manner. A photosensitive drum 1 is rotatably driven about its central rotational axis at a predetermined peripheral velocity, and during this rotation, its peripheral surface is uniformly charged by a charger 3 to the positive or negative polarity. This uniformly charged surface of the photosensitive drum is exposed to a scanning beam of light, which is emitted from a solid-state laser element 102 (FIG. 8) being activated or deactivated in response to the image signal, and is reflected by a rotary polygon mirror 104 being rotated at a high speed in such a manner as to cause the beam of light to scan the surface of the photosensitive drum 1, whereby an electrostatic image reflecting the original image is sequentially formed on the photosensitive drum 1.

FIG. 8 is a schematic view of a laser scanning section 100 of the aforementioned apparatus, depicting its structure. In this laser scanning section 100, the solid-state laser element 102 is turned on or off by an emission signal generating device 101 with a predetermined timing in response to an inputted image signal. The laser light emitted from the solid-state laser element 102 is converted into substantially parallel rays by a collimator lens system 103, and is caused to scan in the direction of an arrow mark b by the rotary polygon mirror 104 rotating in the direction of an arrow mark b, being focused as a spot on a surface to be scanned 106, such as the photosensitive drum, by an f-θ lens group comprising lenses 105*a*, 105*b* and 105*c*, whereby exposure distribution correspondent to a single scanning line is formed on the scanned surface 106. After completion of each line of scanning, the surface to be scanned 106 is scrolled in the direction perpendicular to the scanning direction by a predetermined distance, whereby the exposure distribution correspondent to the image signal is obtained on the scanned surface 106.

Next, a development process will be described. Generally speaking, development processes can be roughly classified into four groups: single-component development process of the noncontact type, in which an image is developed in a noncontact manner with nonmagnetic or magnetic toner, which is coated on a sleeve using a blade or the like, or magnetic force, respectively, and delivered to a photosensitive drum; single-component development process of the contact type, in which an image is developed as the photosensitive drum comes in contact with the toner coated in the above mentioned manner; two-component development process of the contact type, in which an image is developed in a noncontact manner by developer composed of toner particle and magnetic carrier particles, wherein the toner is magnetically delivered to the photosensitive drum; and two-component development process of the noncontact type, in which an image is developed in a noncontact manner with the aforementioned two-component developer. Among these four groups, the two-component development process of the contact type is more widely used in consideration of image quality and image stability.

FIG. 3 is a schematic view of a developing apparatus 4 to be used with the two-component development process of a magnetic brush type employed in this example of a conventional apparatus. In the drawing, a reference numeral 11 designates a developing sleeve; 12, a magnetic roller disposed fixedly within the developing sleeve; 13 and 14, are stirring screws; 15, a regulator blade disposed to form a thin layer of developer on the developing sleeve surface; and a reference numeral 16 designates a developer container The toner of the two-component developer used in this conventional apparatus is manufactured using a pulverizing method, and the toner powder contains an additive, titanium oxide, by 1 wt %. As for the carrier, magnetic carrier particles are is employed, which have a saturation magnetization level of 205 emu/cm$^3$. The average particle diameters are 8 $\mu$m for the toner, 20 nm for the titanium oxide, and 50 $\mu$m for the carrier. These toner particles are mixed by a weight ratio of 5:95 to compose the developer.

Next, a description will be given as to the development process in which an image is visualized using the aforementioned developing apparatus of a magnetic brush type, in conjunction with two-component developer, and a description will be also given as to a circulating system for the developer. First, as the developing sleeve 11 is rotated, the developer is picked up onto the developing sleeve 11 with the function of an N2 magnetic pole. Then, as the developer on the developing sleeve 11 is conveyed past an S2 pole and an N1 pole, it is regulated to form a thin layer, by the regulating blade 15 disposed-perpendicular to the developing sleeve 11. As the thin layer of the developer thus formed is delivered to a primary developing pole S1, the developer is caused to stand up like a string or chain, by the magnetic force. The aforementioned electrostatic latent image is developed by this chain of the developer, and thereafter, the developer remaining on the developing sleeve 11 (hereinafter, residual toner) is returned to the developer container 16 by the repulsive magnetic field from an N3 pole and the N2 pole.

As for the developing sleeve 11, DC and AC biases are applied thereto from an unillustrated power source. In the case of the two-component developing method, when an AC bias is applied, developing efficiency generally increases, and image quality improves, but there is a danger in that fog is liable to occur.

The toner image thus formed on the photosensitive drum 1 is electrostatically transferred onto a piece of transfer material by a transfer charger 7 (see FIG. 2). Thereafter, the transfer material is electrostatically separated by a separator charger 8 and is delivered to a fixing device 6, which fixes the image to the transfer material which is discharged as a copy. Meanwhile, after transferring of the toner image, the surface of the photosensitive drum 1 is cleaned of contaminants such as the residual toner by a cleaner 5, and is repeatedly used for image formation. The structure described above is only one example among the various apparatus structures, whereas the charger 2 may be a charging roller instead of a charger of the corona type, and the transfer charger 7 may be a transfer roller. In other words, any structure is acceptable as long as an image is formed as described above, basically through the steps of charging, exposing, developing, fixing and cleaning.

Recently, size reduction has been in progress for the above described apparatus, but there has been a limit to the efforts for reducing the apparatus size by reducing the size of each of the charging, exposing, developing, transferring, fixing and cleaning devices. Further, even though the residual toner is recovered as waste toner by the cleaner 5, it is preferable, from a standpoint of environmental protection as well as other reasons, that this waste toner is not generated.

Thus, cleanerless apparatuses have appeared, in which the cleaner 5 has been eliminated, and photosensitive drum cleaning and image developing are simultaneously carried out by the developing apparatus 4. This simultaneous developing-cleaning refers to a method in which a slight amount of toner remaining on the transfer drum after image transfer is recovered by a fog removing bias $V_{back}$ during an immediately succeeding developing process.

According to this method, the recovered residual toner is used for the following image forming process; therefore, the waste toner is not generated. Further, it enjoys a space saving advantage, allowing thereby substantial reduction in apparatus size.

However, when an attempt has been made to recover the residual toner using a conventional apparatus, in which the cleaner 5 was removed, and developing and cleaning processes were simultaneously carried out, a positive ghost appeared on a region where no image was supposed to be. This ghost was a ghost image resulting from the image formed on the photosensitive drum during a preceding rotation thereof. More specifically, it was a ghost image created from the trace of the preceding image when the toner remaining on the photosensitive drum after the image transfer of the preceding image was not stripped completely, or when the residual toner which was once stripped away from the photosensitive drum and caused to reach the sleeve by a fog removing bias had returned to the photosensitive drum.

SUMMARY OF THE INVENTION

A primary object of the present invention is to provide an image forming apparatus capable of stripping the residual toner from the photosensitive drum while preventing the stripped toner from returning to the photosensitive drum, so that the positive ghost image does not occur.

According to an aspect of the present invention, there is provided an image forming apparatus comprising: an electrostatic image bearing member for bearing an electrostatic image; a developer carrying member for carrying developer containing toner; means for applying to the developer carrying member, an oscillating voltage of a predetermined frequency: toner image forming means for forming a toner image on the electrostatic image bearing member using the voltage applying means; transferring means for transferring the toner image onto transfer material; and removing means for removing, using the voltage applying means, toner remaining on the electrostatic image bearing member after the use of the transferring means; wherein the voltage satisfies:

$$\frac{|Vpp - 2V\text{back}|}{16\,Vf^2} < \frac{d^2}{|Q|} \text{ and } Vpp/d > 2 \times 10^6\ (V/m)$$

$V_{pp}$ [V]: a peak-to-peak voltage of the oscillating voltage $V_f$ [Hz]: a frequency of the oscillating voltage $V_{back}$ [V]: a potential difference between a surface potential of the electrostatic image bearing member and DC component of the oscillating voltage Q [c/kg]: an average amount of toner charge d [m]: a shortest distance between the electrostatic image bearing member and the developer carrying member.

According to another aspect of the present invention, there is provided an image forming apparatus comprising: an electrostatic image bearing member for bearing an electrostatic image; a developer carrying member for carrying developer containing toner produced by a polymerizing method; means for applying to the developer carrying member, an oscillating voltage of a predetermined frequency; toner image forming means for forming a toner image on the electrostatic image bearing member using the voltage applying means; transferring means for transferring the toner image onto transfer material; and removing means for removing, using the voltage applying means, toner remaining on the electrostatic image bearing member after the use of the transferring means; wherein the voltage satisfies:

$$\frac{|Vpp - 2Vback|}{16Vf^2} < \frac{d^2}{|Q|} \text{ and } Vpp/d > 1 \times 10^6\ (\text{V/m})$$

$V_{pp}$ [V]: a peak-to-peak voltage of the oscillating voltage $V_f$ [Hz]: a frequency of the oscillating voltage $V_{back}$ [V]: a potential difference between a surface potential of the electrostatic image bearing member and DC component of oscillating voltage Q [c/kg]: an average amount of toner charge d [m]: a shortest distance between electrostatic image bearing member and the developer carrying member.

According to another aspect of the present invention, there is provided an image forming apparatus comprising: an electrostatic image bearing member for bearing an electrostatic image; a developer carrying member for carrying developer containing toner; means for applying to the developer carrying member an oscillating voltage of a predetermined frequency, and the AC component of which is interrupted for a duration of α cycles for every predetermined number of cycles; toner image forming means for forming a toner image on the electrostatic image bearing member using the voltage applying means; transferring means for transferring the toner image onto transfer material; and removing means for removing, using the voltage applying means, toner remaining on the electrostatic image bearing member after the use of the transferring means; wherein the voltage satisfies:

$$\frac{S(S+2\alpha)\,|(1-S)Vpp-Vback|}{2Vf^2} < \frac{d^2}{|Q|}$$

and (SVpp+Vback)/d>1×10$^6$ (V/m)

$V_{pp}$ [V]: a peak-to-peak voltage of the oscillating voltage $V_f$ [Hz]: a frequency of the oscillating voltage excluding interrupted period $V_{back}$ [V]: a potential difference between surface potential of the electrostatic image bearing member and DC component of the oscillating voltage Q [c/kg]: an average amount of toner charge d [m]: a shortest distance between the electrostatic image bearing member and the developer carrying member S: a temporal ratio per cycle of the oscillating voltage at which oscillating voltage is applied in the direction of transferring developer onto electrostatic image bearing member (0<S<1)

α: number of periods of AC component interruption per cycle of the oscillating voltage (0≦α).

According to another aspect of the present invention, there is provided an image forming apparatus comprising; an electrostatic image bearing member for bearing an electrostatic image; a developer carrying member for carrying developer containing toner produced by a polymerizing method; means for applying to the developer carrying member an oscillating voltage of a predetermined frequency; and the AC component of which is interrupted for a duration of α cycles for every predetermined number of cycles; toner image forming means for forming a toner image on the electrostatic image bearing member using the voltage applying means; transferring means for transferring the toner image onto transfer material; and removing means for removing, using the voltage applying means, the toner remaining on the electrostatic image bearing member after the use of the transferring means; wherein the voltage satisfies:

$$\frac{S(S+2\alpha)\,|(1-S)Vpp-Vback|}{2Vf^2} < \frac{d^2}{|Q|}$$

and (SVpp +$V_{back}$)/d>5×10$^5$ (V/m)

$v_{pp}$ [V]: a peak-to-peal voltage of the oscillating voltage $V_f$ [Hz]: a frequency of the oscillating voltage excluding interrupted period $V_{back}$ [V]: a potential difference between surface potential of the electrostatic image bearing member and a DC component of oscillating voltage Q [c/kg]: an average amount of toner charge d [m]: a shortest distance between electrostatic image bearing member and developer carrying member S: a temporal ratio per cycle of oscillating voltage at which oscillating voltage is applied in the direction of transferring developer onto electrostatic image bearing member (0<S<1)

α: number of periods of AC component interruption per cycle of alternating voltage (0≦α).

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENT 1

Figure 1:
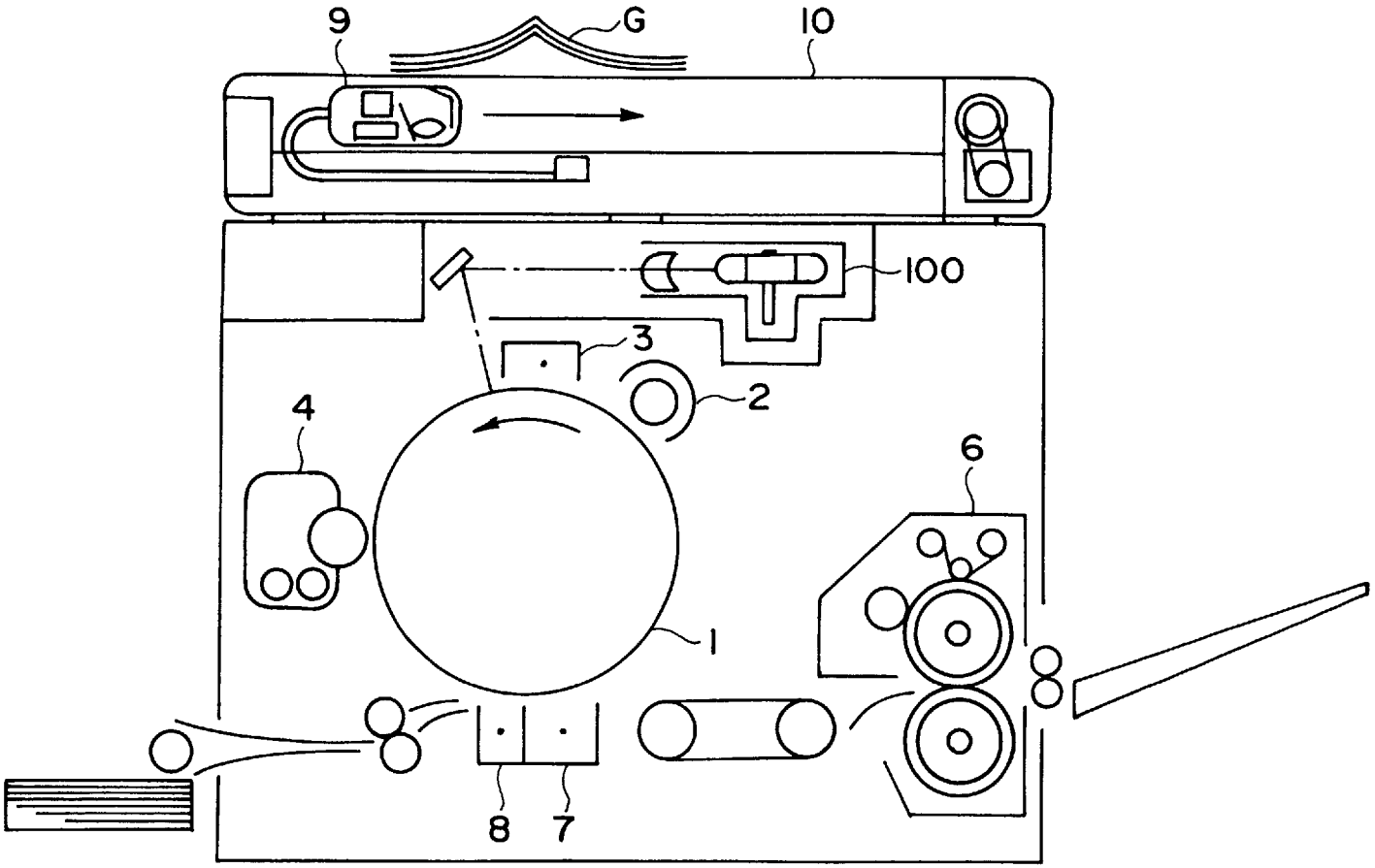
FIG. 1 is a schematic view of a typical digital electrophotographic copying apparatus used in Embodiments 1–4 of the present invention.
Figure 2:
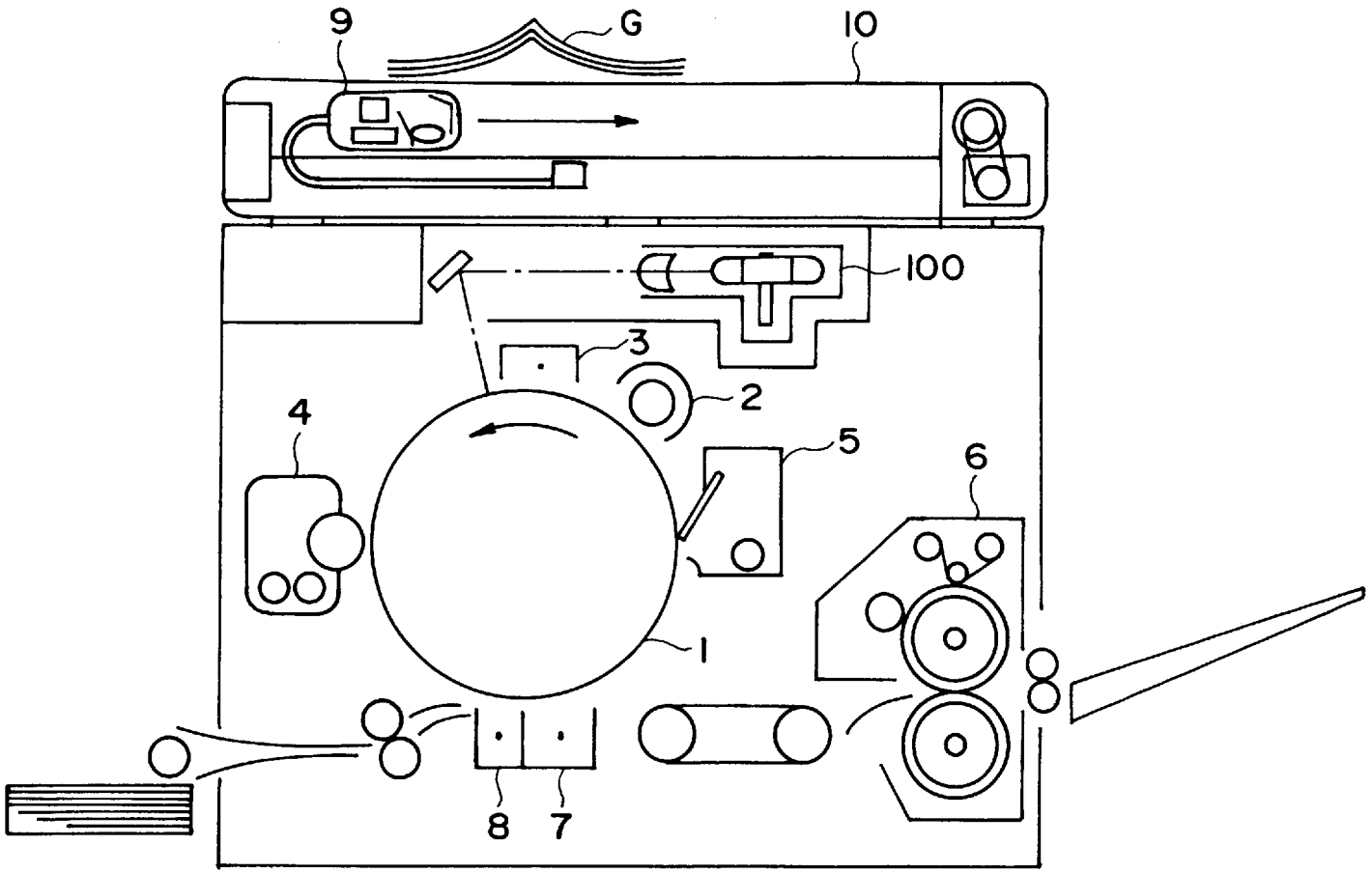
FIG. 2 is a schematic view of a typical conventional digital electro-photographic copying machine.

FIG. 1 is a schematic view of an image forming apparatus in accordance with the present invention.

First, an original G is placed on an original table 10 with the image to be copied facing downward. Next, a copy button is pressed to start copying. The original is scanned by a light beam from an integrated unit 9 comprising an original illuminating lamp, a short focus lens array, and a CCD sensor. The scanning light reflected by the original surface is focused by the short focus lens array, being projected onto the CCD sensor which comprises a light receiving section, a transfer section, and an output section. In the CCD section, the light signal is converted into an electric signal, which is sequentially transferred to the output section in synchronism with a clock pulse, through the transfer section. In the output section, a charge signal is converted into a voltage signal, which is outputted, with reduced impedance, after being amplified. An analog signal thus obtained is subjected to the well-known imaging process, being thereby converted into a digital signal, which is sent to a printing section. The printing section having received the image signal forms an electrostatic latent image in the following manner.

Figure 8:
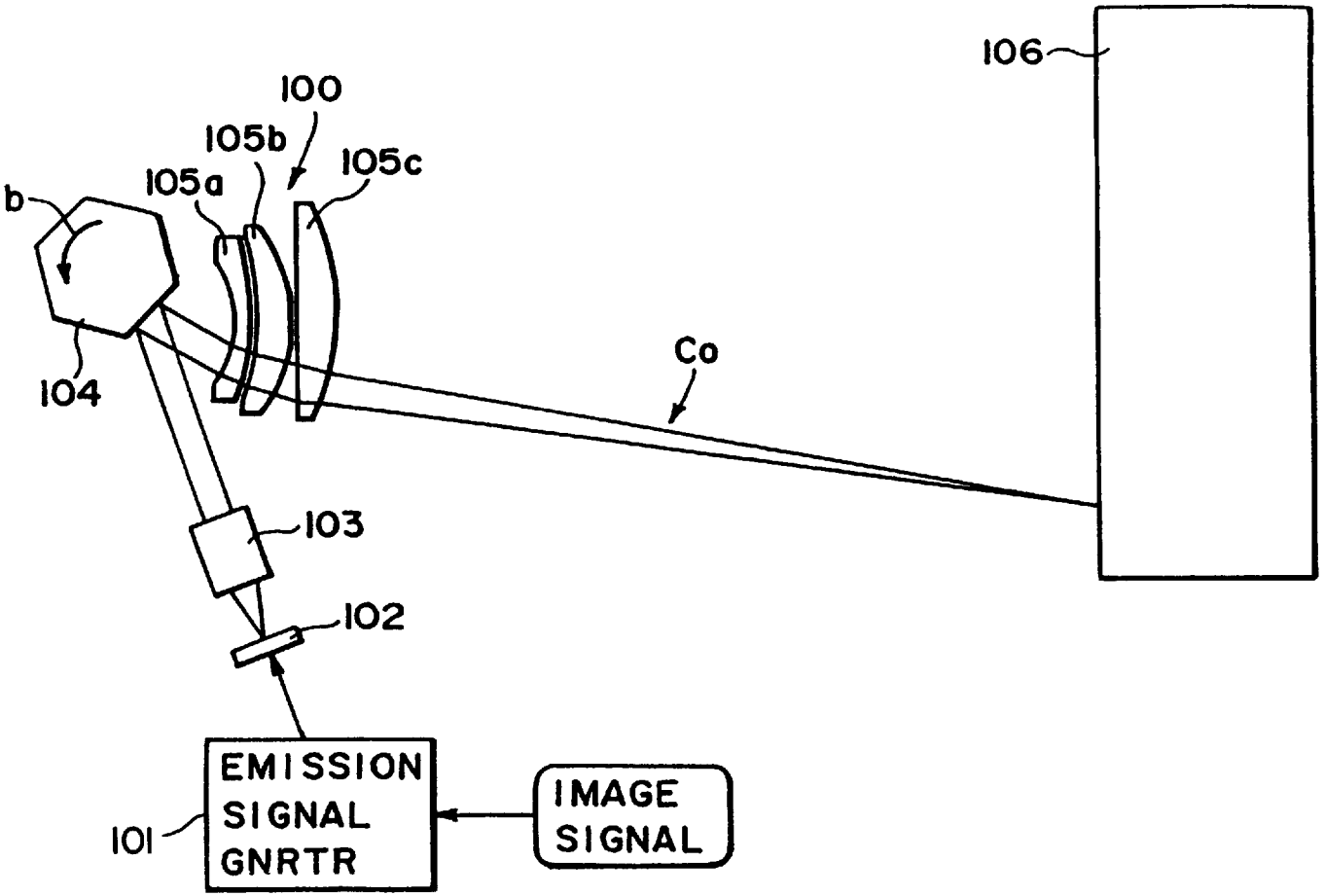
FIG. 8 is a schematic view of the laser scanning section.

A photosensitive drum 1 known as the image bearing member is rotatively driven about its central rotational axis at a predetermined peripheral velocity, and during this rotation, its peripheral surface is uniformly charged by a charger 3 to the positive or negative polarity. This uniformly charged surface of the photosensitive drum is exposed to a scanning beam of light, which is emitted from a solid-state laser element 102 (FIG. 8) being activated or deactivated in response to the image signal, and is reflected by a rotary polygon mirror 104 being rotated at a high speed in such a manner as to cause the beam of light to scan the surface of the photosensitive drum 1, whereby an electrostatic image representing the original image is sequentially formed on the photosensitive drum 1. This electrostatic latent image is developed as a toner image on the photosensitive drum by a developing apparatus, which will be described later. The toner image thus formed on the photosensitive drum 1 is electrostatically transferred onto transfer material by a transfer charger 7. Thereafter, the transfer material is electrostatically separated by a separator charger 8 and is delivered to a fixing device 6, which fixes the image to the transfer material which is discharged as a copy.

On the other hand, after the transfer of the toner image, a certain amount of the toner still remains on the surface of the photosensitive drum 1, and this residual toner is recovered by the developing apparatus during the next rotation.

This is just an example among the various structures of the image forming apparatus, whereas the charger 3 may be a charging roller instead of a charger of the corona type, and the transfer charger 7 may be a transfer roller. In other words, any structure will suffice as long as it forms an image, as described above, through the steps of charging, exposing, developing, fixing and cleaning, and the residual toner is recovered by the developing apparatus 4.

Hereinafter, an embodiment of developing apparatus 4 employing the image forming method which is in accordance with the present invention will be described with reference to the drawings.

Figure 3:
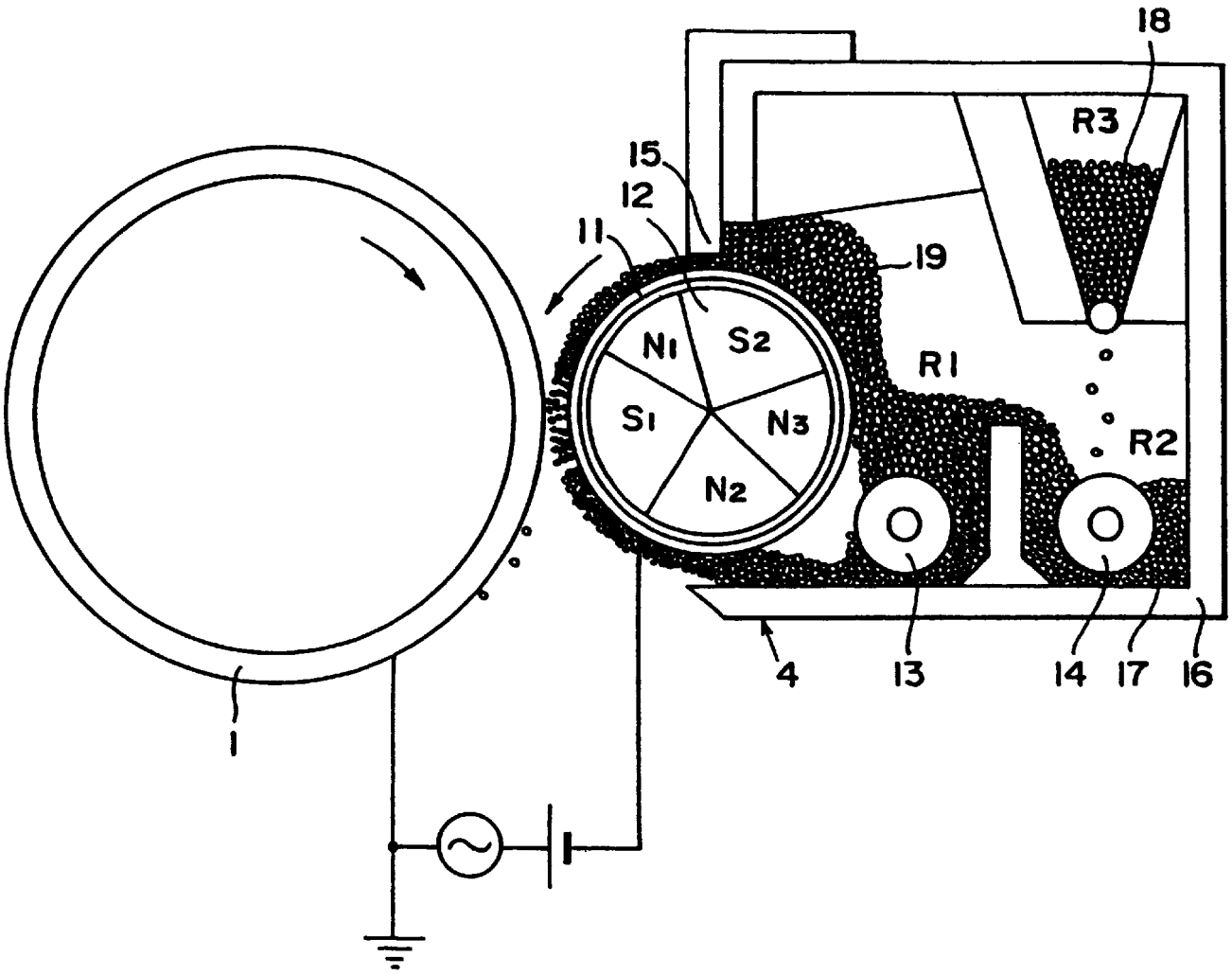
FIG. 3 PRIOR ART
FIG. 3 is a schematic view of a two-component developing apparatus.

FIG. 3 is a structural view of the developing apparatus 4 used in this embodiment of the present invention.

Referring to FIG. 3, this developing apparatus 4 comprises a developer container 16.

The internal space of the developer container 16 is divided into a developing chamber (first chamber) R1, a stirring chamber (second chamber) R2, and a toner storing chamber R3, which are separated by partition walls 17, wherein the toner storing chamber R3 is disposed above the stirring chamber R2, and contains a supply of toner 18 (nonmagnetic toner). In the partition wall, a supply port 20 is provided, through which the toner from the toner supply 18 is allowed to fall into the stirring chamber R2 by the amount proportional to the consumed amount of the toner.

In the developing chamber R1 and stirring chamber R2, developer 19 is contained. This developer 19 is two-component developer composed of toner and magnetic carrier. The toner is manufactured by the pulverizing method and contains an additive of titanium oxide by 1 wt %. The magnetic carrier has a saturation magnetization level of 205 emu/cm$^3$. The average particle diameters are 8 $\mu$m for the toner, 20 nm for the titanium oxide, and 50 $\mu$m for the magnetic carrier (the mixing ratio is established so as for the nonmagnetic toner to occupy approximately 5% by weight).

The developer container 16 is provided with an opening disposed adjacent to the photosensitive drum 1, wherein a developing sleeve 11, as the developer carrying member, projects outward from this opening. The developing sleeve 11 is rotatively assembled into the developer container 16. The outer diameter of the developing sleeve 11 is 32 mm, and its peripheral velocity is 280 mm/s. The developing sleeve 11 is disposed so as to hold a distance of 500 $\mu$m from the photosensitive drum 1. The developing sleeve 11 is made of nonmagnetic material, and a is magnet 12 is disposed therein as means for generating a magnetic field.

The magnet 12, which comprises a developing magnetic pole S1, a magnetic pole N3 disposed on the downstream side thereof, and magnetic poles N2, S2 and N1 for conveying the developer 19, is disposed within the developing sleeve 11 in such a manner that the developing magnetic pole S1 comes to face the photosensitive drum 1. The developing magnetic pole S1 induces a magnetic field around a developing station situated between the developing sleeve 11 and photosensitive drum 1, and this magnetic field forms a magnetic brush.

Above the developing sleeve 11, a blade 15 is disposed, holding a predetermined distance from the developing sleeve. The distance between the developing sleeve 11 and blade 15 is 800 $\mu$m, The blade 15 is fixed to the developing container 16. The blade 15 is formed of nonmagnetic material such as aluminum or SUS316, and regulates the thickness of the developer layer formed on the developing sleeve 11.

Within the developing chamber R1, a conveyer screw 13 is disposed. The conveyer screw 13 is rotated in the direction indicated by an arrow mark in the drawing, and the developer 19 within the developing chamber R1 is conveyed in the longitudinal direction of the developing sleeve 11 as this conveyer screw 13 is rotatively driven.

Within the storing chamber R2, a conveyer screw 14 is disposed. The toner is conveyed by the rotation of the conveyer screw 14 in the longitudinal direction of the developing sleeve 11, and falls into the stirring chamber R2 through the supply port 20.

As for the pulverized toner used in this embodiment, two types were used: one with an approximately $2.0\times10^{-2}$ c/kg of triboelectric charge and the other with an approximately $3.0\times10^{-2}$ c/kg of triboelectric charge.

Next, a method for measuring the amount of triboelectric charge of the toner (two-component developer) will be described with reference to the drawing.

Figure 4:
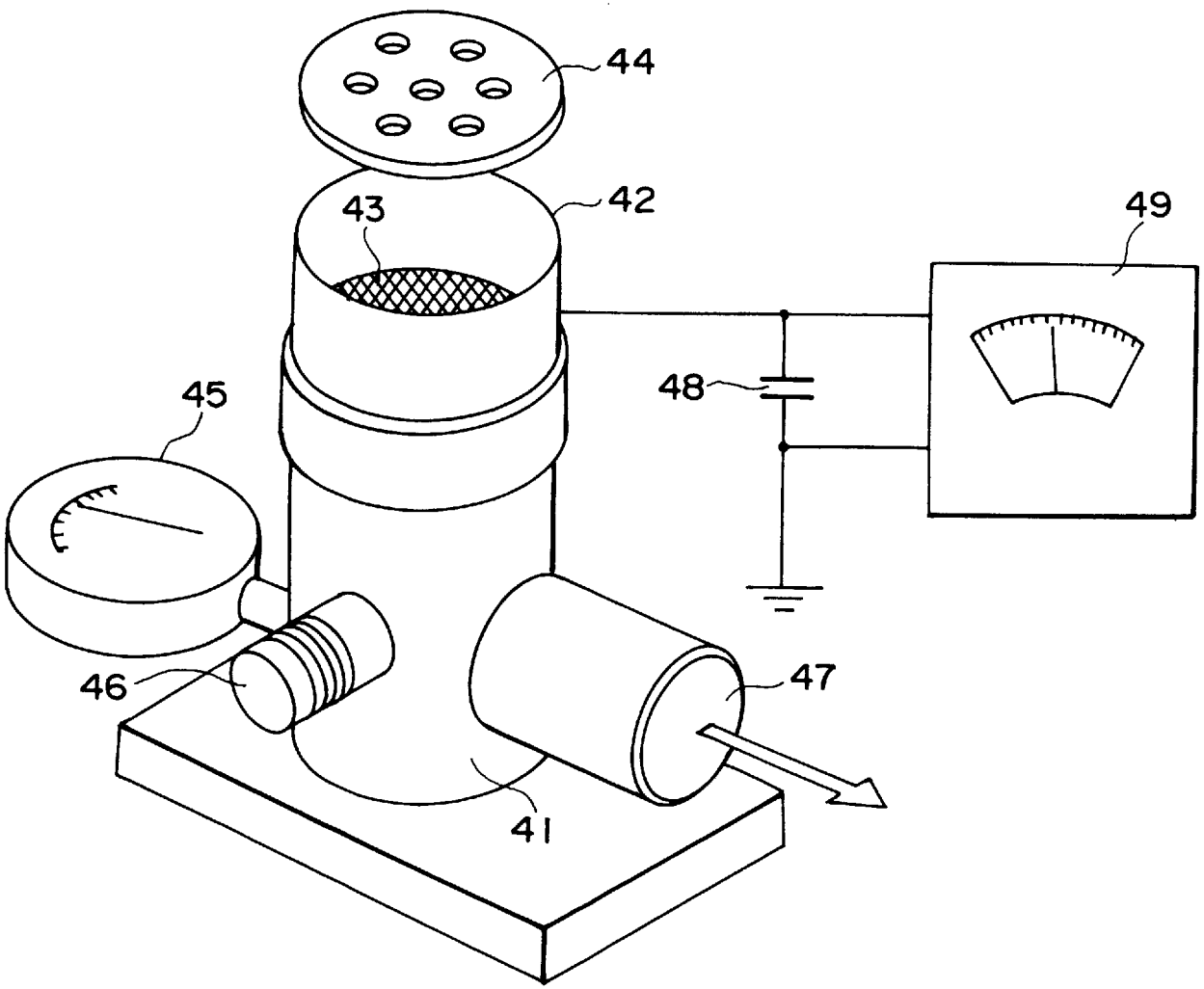
FIG. 4 is a schematic view of an apparatus for measuring the amount of the triboelectric charge of two-component developer.

FIG. 4 is an explanatory drawing of an apparatus for measuring the amount of the triboelectric charge of the toner. First, the two-component developer to be measured in triboelectric charge is placed in a 50–100 ml polyethylene bottle, and shaken approximately 10–40 seconds. Then, approximately 0.5–1.5 g of this developer is put in a measuring container 42 provided with a #500 mesh screen, and a metallic cover 44 is placed on the container 42. The overall weight of the measuring container 42 measured including content at this time is designated by W1 (kg). Next, the developer is sucked through a sucking port 47 by a sucking device 41 (electrically nonconductive, at least at the areas that come ill contact with the measuring container 42) while adjusting a sucking volume adjuster valve 46 so as for the pressure indicated by a vacuum gauge to display 250 mmAq. Under this condition, sucking is continued for a sufficient duration, preferably, for a duration of two minutes, to suck away the resin. The potential displayed at this time by a voltmeter 49 is designated by V. A reference numeral 48 designates a capacitor, the capacity of which is designated by C (F). The overall weight of the measuring container 42 after the suction is designated by W2 (kg). The amount of the triboelectric charge of this toner is calculated using the following formula.

$$\text{amount of triboelectric charge } (c/\text{kg}) = (C \times V \times 10^{-3})/(W_1 - W_2)$$

Next, conditions are described under which the toner is not caused to shuttle between the photosensitive drum and developing sleeve when an alternating electric field is applied by a single pulse.

$$\frac{|Vpp - 2Vback|}{16Vf^2} < \frac{d^2}{|Q|}$$

Under such bias conditions, the toner collects on the developing sleeve side when $V_{cont}<0$, wherein $V_{cont}$ is the potential difference between the surface potential of the photosensitive drum and the DC component of the developing bias; and when $V_{cont}>0$, it collects on the photosensitive drum side. In other words, when $V_{back}$ (fog removing potential) >0, the toner collects on the sleeve side.

Figure 7A:
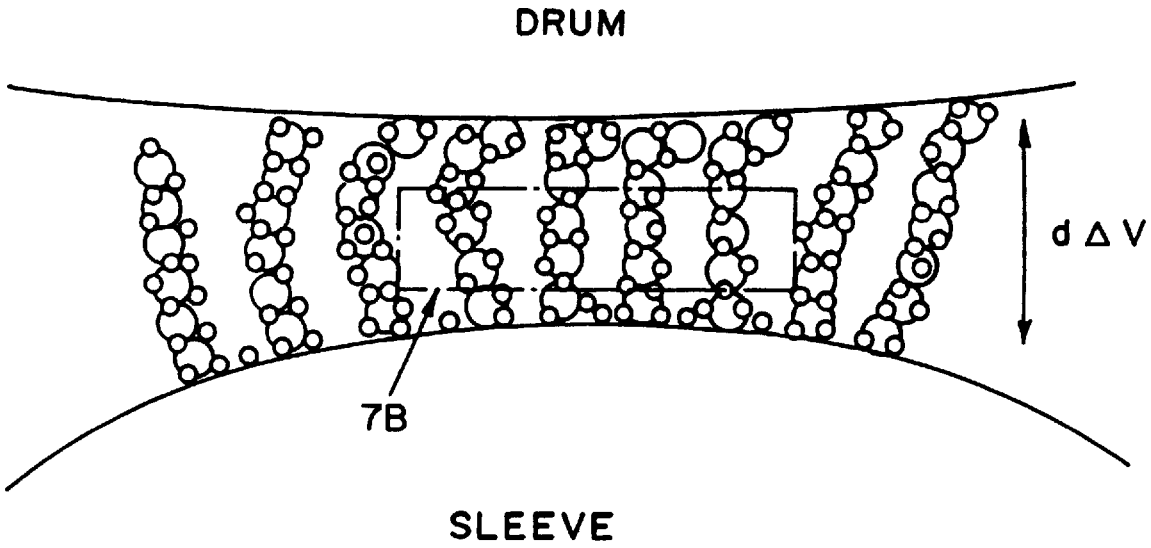
FIGS. 7A and 7B are a schematic drawing describing the force affecting the toner and an enlarged view of toner/developing brush chains.
Figure 7B:
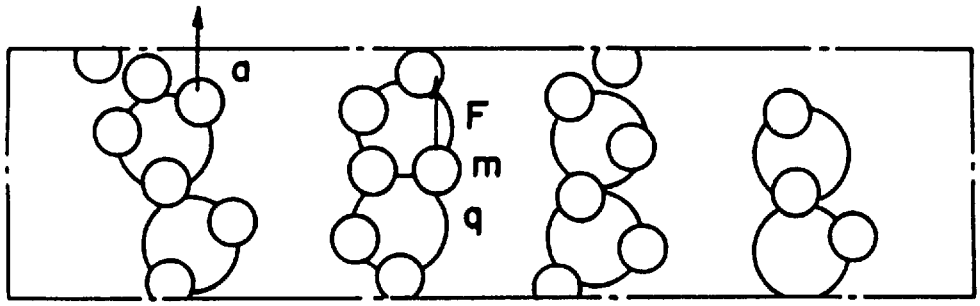

Below, this formula will be further described in detail. FIGS. 7A and 7B depicts the forces that works on a single particle of the toner on the developing sleeve. In the drawing, a reference q designates an amount of charge; m, mass; a, acceleration; V, potential difference between the photosensitive drum and developing sleeve; and a reference d designates a gap between the photosensitive drum and developing sleeve.

An alternating voltage is applied from the developing sleeve to the toner remaining on the electrostatic image portion in the white background area for a duration of $1/(2V_f)$ second per cycle of the alternating voltage. The distance X that the toner can travel between the photosensitive drum and developing sleeve is calculated using the following formulas:

$$X = \frac{1}{2} a \left(\frac{1}{2Vf}\right)^2 = \frac{1}{2}\left(\frac{|q|}{m} \cdot \frac{\Delta V}{d}\right)\frac{1}{4Vf^2} = \frac{1}{2}|Q| \cdot \frac{\Delta V}{d} \cdot \frac{1}{4Vf^2} = \frac{|Q| - \Delta V}{8d - Vf^2}$$

For the developing to photosensitive drum direction.

$$X_+ = \frac{|Q| \cdot \left|\frac{1}{2} Vpp - Vback\right|}{8d \cdot Vf^2}$$

For the photosensitive drum to developing sleeve direction.

$$X_- = \frac{|Q| \cdot \left|\frac{1}{2} Vpp + Vback\right|}{8d \cdot Vf^2}$$

At this time, the behavior of the residual toner having been stripped from the electrostatic latent image portion in the white background area will be described. Since $V_{back}>0$, and $X_+<X_-$, which means that when a full cycle of an alternating voltage is repeatedly applied, the stripped residual toner never fails to reach the developing sleeve. Therefore, when certain conditions are established so that the distance $X_+$, which the residual toner travels when a single cycle of the developing voltage is applied, becomes insufficient for the residual toner to reach the photosensitive drum, the residual toner having once reached the developing sleeve keeps on oscillating on the developing sleeve side, without being able to return to the photosensitive drum (This is because $X_+<X_-$). Such conditions are given below, under which $X_+$ becomes smaller than the gap d between the photosensitive drum and developing sleeve.

$$\frac{|Q| \cdot \left|\frac{1}{2} Vpp - Vback\right|}{8d \cdot Vf} < d$$

where $$\frac{|Vpp - 2Vback|}{16Vf^2} < \frac{d^2}{|Q|}$$

Under these conditions, $V_{back}<0$ as far as the image portion is concerned; therefore, $X_+>X_-$. In other words, the conditions become such that the distance X, which the toner having been transferred onto the latent image on the photosensitive drum travels when a single cycle of the stripping voltage is applied, is not sufficient for the toner to be returned to the developing sleeve; therefore, the toner oscillates while remaining on the photosensitive drum side.

As a result, the toner jumps in a manner to concentrate toward the electrostatic latent image on the photosensitive drum, improving thereby image quality.

Figure 6:
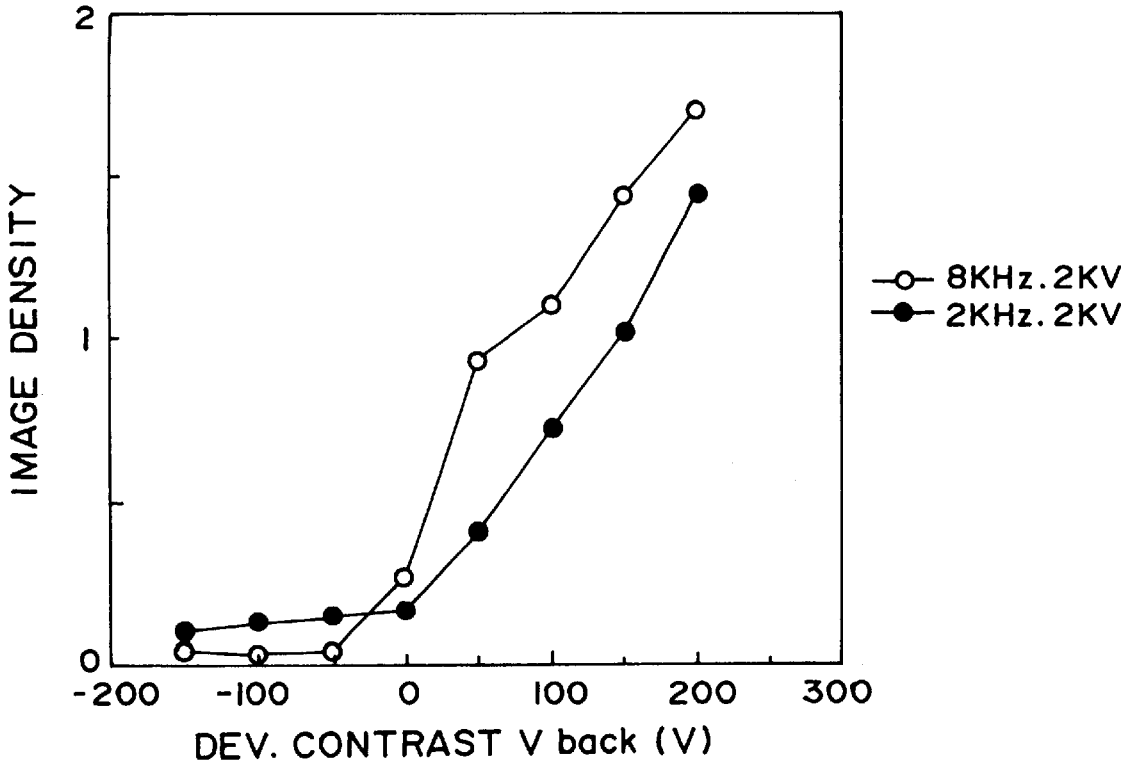
FIG. 6 is a graph showing the V-D curve for a bias which is in accordance with the conditions of the present invention, and the V-D curves for other biases.

FIG. 6 shows the V-D (contrast and density) curves obtained when a latent analog image is visualized using a developing bias which is in accordance with the above described conditions, and another developing bias (which is liable to cause the positive ghost). As is evident from FIG. 6, when a latent analog image is visualized using the developing bias which is in accordance with the above described conditions, the fog hardly occurs, and developing efficiency is substantially improved.

In this embodiment, a cleanerless image forming apparatus in which the residual toner is recovered during the developing process was evaluated, wherein the bias applied during the developing process was varied to observe whether or not the positive ghost occurred. Tables 1–4 correspond to: when the frequency $V_f$ of an alternating voltage is varied; when the peak-to-peak voltage $V_{pp}$ of an alternating voltage is varied; when $V_{back}$ was varied and the frequency $V_f$ was fixed at 2 kHz; and when $V_{back}$ was varied and the frequency $V_f$ was fixed at 4 kHz.

TABLE 1

| TRIBO-ELECTRIC CHARGE | Vf | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ | 1000 HZ | Y | $1.1 \times 10^{-4}$ > | $1.3 \times 10^{-5}$ | $4.0 \times 10^{6}$ |
| c/kg | 2000 HZ | Y | $2.7 \times 10^{-5}$ > | $1.3 \times 10^{-5}$ | $4.0 \times 10^{6}$ |
| | 4000 HZ | N | $6.6 \times 10^{-6}$ < | $1.3 \times 10^{-5}$ | $4.0 \times 10^{6}$ |
| | 8000 HZ | N | $1.7 \times 10^{-6}$ < | $1.3 \times 10^{-5}$ | $4.0 \times 10^{6}$ |
| $3.0 \times 10^{-2}$ | 1000 HZ | Y | $1.1 \times 10^{-4}$ > | $8.3 \times 10^{-6}$ | $4.0 \times 10^{6}$ |
| c/kg | 2000 HZ | Y | $2.7 \times 10^{-5}$ > | $8.3 \times 10^{-6}$ | $4.0 \times 10^{6}$ |
| | 4000 HZ | N | $6.6 \times 10^{-6}$ < | $8.3 \times 10^{-6}$ | $4.0 \times 10^{6}$ |
| | 8000 HZ | N | $1.7 \times 10^{-6}$ < | $8.3 \times 10^{-6}$ | $4.0 \times 10^{6}$ |

Vpp = 2000 ⌈V⌋ Vback = 150 ⌈V⌋: CONSTANT
S-D gap (d) = 500 $\mu$m

TABLE 2

| TRIBO-ELECTRIC CHARGE | Vpp | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ | 500 V | Y | $7.8 \times 10^{-7}$ < | $1.3 \times 10^{-5}$ | $1.0 \times 10^{6}$ |
| c/kg | 1000 V | (Y) | $2.7 \times 10^{-6}$ < | $1.3 \times 10^{-5}$ | $2.0 \times 10^{6}$ |
| | 1500 V | N | $4.7 \times 10^{-6}$ < | $1.3 \times 10^{-5}$ | $3.0 \times 10^{6}$ |
| | 2000 V | N | $6.6 \times 10^{-6}$ < | $1.3 \times 10^{-5}$ | $4.0 \times 10^{6}$ |
| $3.0 \times 10^{-2}$ | 500 V | Y | $7.8 \times 10^{-7}$ < | $8.3 \times 10^{-6}$ | $1.0 \times 10^{6}$ |
| c/kg | 1000 V | (Y) | $2.7 \times 10^{-6}$ < | $8.3 \times 10^{-6}$ | $2.0 \times 10^{6}$ |
| | 1500 V | N | $4.7 \times 10^{-6}$ < | $8.3 \times 10^{-6}$ | $3.0 \times 10^{6}$ |
| | 2000 V | N | $6.6 \times 10^{-6}$ < | $8.3 \times 10^{-6}$ | $4.0 \times 10^{6}$ |

Vf = 4000 ⌈kHZ⌋ Vback = 150 ⌈V⌋: CONSTANT
S-D gap (d) = 500 $\mu$m

TABLE 3

| TRIBO-ELECTRIC CHARGE | Vback | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ | 50 V | Y | $3.0 \times 10^{-5}$ > | $1.3 \times 10^{-5}$ | $4.0 \times 10^{6}$ |
| c/kg | 100 V | Y | $2.8 \times 10^{-5}$ > | $1.3 \times 10^{-5}$ | $4.0 \times 10^{6}$ |
| | 150 V | Y | $2.7 \times 10^{-5}$ > | $1.3 \times 10^{-5}$ | $4.0 \times 10^{6}$ |
| | 200 V | Y | $2.5 \times 10^{-5}$ > | $1.3 \times 10^{-5}$ | $4.0 \times 10^{6}$ |
| $3.0 \times 10^{-2}$ | 50 V | Y | $3.0 \times 10^{-5}$ > | $8.3 \times 10^{-6}$ | $4.0 \times 10^{6}$ |
| c/kg | 100 V | Y | $2.8 \times 10^{-5}$ > | $8.3 \times 10^{-6}$ | $4.0 \times 10^{6}$ |
| | 150 V | Y | $2.7 \times 10^{-5}$ > | $8.3 \times 10^{-6}$ | $4.0 \times 10^{6}$ |
| | 200 V | Y | $2.5 \times 10^{-5}$ > | $8.3 \times 10^{-6}$ | $4.0 \times 10^{6}$ |

Vpp = 2000 ⌈V⌋ Vf = 2000 ⌈kHz⌋: CONSTANT
S-D gap (d) = 500 $\mu$m

TABLE 4

| TRIBO-ELECTRIC CHARGE | Vback | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ | 50 V | N | $7.4 \times 10^{-6}$ < | $1.3 \times 10^{-5}$ | $4.0 \times 10^{6}$ |
| c/kg | 100 V | N | $7.0 \times 10^{-6}$ < | $1.3 \times 10^{-5}$ | $4.0 \times 10^{6}$ |
| | 150 V | N | $6.6 \times 10^{-6}$ < | $1.3 \times 10^{-5}$ | $4.0 \times 10^{6}$ |
| | 200 V | N | $6.3 \times 10^{-6}$ < | $1.3 \times 10^{-5}$ | $4.0 \times 10^{6}$ |
| $3.0 \times 10^{-2}$ | 50 V | N | $7.4 \times 10^{-6}$ < | $8.3 \times 10^{-6}$ | $4.0 \times 10^{6}$ |
| c/kg | 100 V | N | $7.0 \times 10^{-6}$ < | $8.3 \times 10^{-6}$ | $4.0 \times 10^{6}$ |
| | 150 V | N | $6.6 \times 10^{-6}$ < | $8.3 \times 10^{-6}$ | $4.0 \times 10^{6}$ |
| | 200 V | N | $6.3 \times 10^{-6}$ < | $8.3 \times 10^{-6}$ | $4.0 \times 10^{6}$ |

Vpp = 2000 ⌈V⌋ Vf = 4000 ⌈kHz⌋: CONSTANT
S-D gap (d) = 500 $\mu$m

As for evaluative references, a reference Y designates a case in which the positive ghost was visually observed; N, a case in which the positive ghost was not observed visually; and (Y) designates a case in which an extremely light positive ghost occurred.

As is evident from Tables 1–3, when the relation between A and B satisfies an inequality, A<B, the positive ghost occurrence could be prevented, provided that an inequality, $V_{pp}/d>2\times10^6$ (V/m) was satisfied.

At this time, what is meant by the above Formula 7 will be described.

To begin with, the formula, $V_{pp}/d>2\times10^6$, represents the strength of an alternating voltage. The residual toner can be stripped from the photosensitive drum by an alternating voltage having enough strength to satisfy the above formula. As described before, after being stripped from the photosensitive drum, the residual toner from the electrostatic latent image portion of the white background area reaches the developing sleeve, wherein, the inequality, A<B, means that the residual toner having reached the developing sleeve does not return to the photosensitive drum. In other words, it means that when these two formulas are satisfied, the residual toner on the electrostatic latent image portion of the white background area is stripped away from the photosensitive drum and does not return to the photosensitive drum.

As described hereinbefore, when a developing bias in accordance with the following conditions is applied to the developing sleeve of the cleanerless image forming apparatus, the residual toner on the electrostatic latent image portion in the white background area is stripped from the photosensitive drum during the developing process, and does not return to the photosensitive drum; therefore, a preferable image not suffering from positive ghost can be produced.

$$\frac{|Vpp - 2Vback|}{16Vf^2} < \frac{d^2}{|Q|} \text{ and } Vpp/d > 2 \times 10^8 \text{ (V/m)}$$

Embodiment 2

The toner of the two-component developer used in Embodiment 1 was manufactured using a pulverizing method. Its average particle diameter was 8 μm, and contained additive of titanium oxide, by 1 wt %. The average particle diameter of the titanium oxide was 20 nm. However, in this embodiment, spherical toner manufactured using a polymerizing method was used. It also contains the additive, titanium oxide, by 1 wt %, the average diameter of which was also 20 nm (1 wt %). The toner produced using the polymerizing method is substantially spherical; therefore, it is uniformly coated with the additive, which offers a superior separative properties relative to the photosensitive drum. For example, when the transfer efficiency (amount of the toner transferred onto a sheet of paper per unit area) was compared between the two types of toner produced by the pulverization and polymerization, respectively, it was 90% for the pulverized toner, whereas it was 97% for the polymerized toner, being much higher. The polymerized toner was more preferable with regard to fog prevention than the pulverized toner, and also, when the polymerized toner was used, the fog could be prevented even when $V_{back}$=50V.

As is evident from the above description, when the polymerized toner is used, the amount of the residual toner is extremely small. Also, the polymerized toner displays higher separativeness; therefore, when it is used in conjunction with a cleanerless structure which recovers the residual toner during the developing process, the recovery efficiency improves. Consequently, the occurrence of the fog is virtually eliminated.

Figure 5:
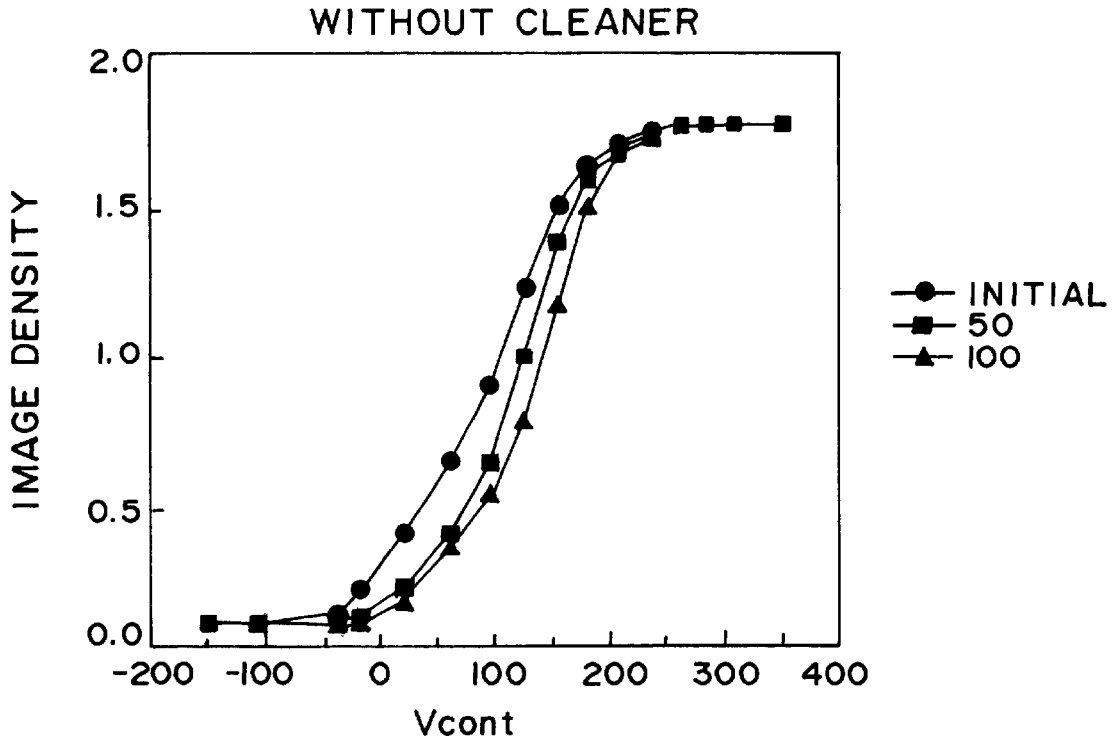
FIG. 5 is a graph showing the image density change that occurs when sheets are continuously fed.

However, when sheets were continuously fed while using the polymerized toner in conjunction with a cleanerless system, the image density in the low density area gradually declined as shown in FIG. 5. In FIG. 5, a reference ● indicates the image density for the initial contrast; ■, the image density for the contrast after the continuous passage of 50 sheets; and a black triangular reference designates the image density for the contrast after the continuous passage of 100 sheets. As a result of the study of this phenomenon, it has been revealed that this phenomenon occurred as the additive titanium oxide accumulated on the photosensitive drum. More specifically, as the additive accumulated on the drum surface, the separativeness further improved; therefore, the toner was stripped by the alternating voltage on the downstream side of the developing station.

Thus, in this embodiment, evaluations were made, varying the bias applied during the developing process as it was in Embodiment 1, with regard to whether or not the positive ghost occurred, and also, with regard to the density change in the low density area. Tables 5–7 correspond to: when the frequency $V_f$ of the alternating voltage was varied; when the peak-to-peak voltage $V_{pp}$ of the alternating voltage was varied, and when $V_{back}$ was varied.

TABLE 5

| TRIBO-ELECTRIC CHARGE | Vf | POSITIVE GHOST | DENSITY CHANGE | A $\frac{\lvert Vpp - 2\,V\,back\rvert}{16\,Vf^2}$ | B $\frac{d^2}{Q}$ | Vpp/d |
|---|---|---|---|---|---|---|
| $2.0 \times 10^{-2}$ | 1000 HZ | Y | Y | $1.1 \times 10^{-4}$ > | $1.3 \times 10^{-5}$ | $4.0 \times 10^6$ |
| c/kg | 2000 HZ | N | Y | $2.7 \times 10^{-5}$ > | $1.3 \times 10^{-5}$ | $4.0 \times 10^6$ |
| | 4000 HZ | N | N | $6.6 \times 10^{-6}$ < | $1.3 \times 10^{-5}$ | $4.0 \times 10^6$ |
| | 8000 HZ | N | N | $1.7 \times 10^{-6}$ < | $1.3 \times 10^{-5}$ | $4.0 \times 10^6$ |
| $3.0 \times 10^{-2}$ | 1000 HZ | Y | Y | $1.1 \times 10^{-4}$ > | $8.3 \times 10^{-6}$ | $4.0 \times 10^6$ |
| c/kg | 2000 HZ | N | Y | $2.7 \times 10^{-5}$ > | $8.3 \times 10^{-6}$ | $4.0 \times 10^6$ |
| | 4000 HZ | N | N | $6.6 \times 10^{-6}$ < | $8.3 \times 10^{-6}$ | $4.0 \times 10^6$ |
| | 8000 HZ | N | N | $1.7 \times 10^{-6}$ < | $8.3 \times 10^{-6}$ | $4.0 \times 10^6$ |

Vpp = 2000 ⌈V⌋ Vback = 150 ⌈V⌋: CONSTANT

S-D gap (d) = 500 μm

TABLE 6

| TRIBO-ELECTRIC CHARGE | Vpp | POSITIVE GHOST | DENSITY CHANGE | A $\frac{\lvert Vpp - 2\ Vback}{16\ Vf^2\rvert}$ | B $\frac{d^2}{Q}$ | Vpp/d |
|---|---|---|---|---|---|---|
| $2.0 \times 10^{-2}$ | 250 V | (Y) | N | $7.8 \times 10^{-7}$ < | $1.3 \times 10^{-5}$ | $5.0 \times 10^{5}$ |
| c/k g | 500 V | (Y) | N | $3.1 \times 10^{-6}$ < | $1.3 \times 10^{-3}$ | $1.0 \times 10^{6}$ |
| | 750 V | N | N | $7.0 \times 10^{-6}$ < | $1.3 \times 10^{-5}$ | $1.5 \times 10^{6}$ |
| | 1000 V | N | N | $1.1 \times 10^{-5}$ < | $1.3 \times 10^{-5}$ | $2.0 \times 10^{6}$ |
| $3.0 \times 10^{-2}$ | 250 V | (Y) | N | $7.8 \times 10^{-7}$ < | $8.3 \times 10^{-6}$ | $5.0 \times 10^{5}$ |
| c/k g | 500 V | (Y) | N | $3.1 \times 10^{-6}$ < | $8.3 \times 10^{-6}$ | $1.0 \times 10^{6}$ |
| | 750 V | N | N | $7.0 \times 10^{-6}$ < | $8.3 \times 10^{-6}$ | $1.5 \times 10^{6}$ |
| | 1000 V | N | Y | $1.1 \times 10^{-5}$ > | $8.3 \times 10^{-6}$ | $2.0 \times 10^{6}$ |

Vf = 2000 [kHz] Vback = 150 [V]: CONSTANT
S-D gap (d) = 500 $\mu$m

TABLE 7

| TRIBO-ELECTRIC CHARGE | Vback | POSITIVE GHOST | DENSITY CHANGE | A $\frac{\lvert Vpp - 2\ Vback}{16\ Vf^2\rvert}$ | B $\frac{d^2}{Q}$ | Vpp/d |
|---|---|---|---|---|---|---|
| $2.0 \times 10^{-2}$ | 50 V | Y | Y | $3.0 \times 10^{-5}$ > | $1.3 \times 10^{-5}$ | $4.0 \times 10^{6}$ |
| c/k g | 100 V | (Y) | Y | $2.8 \times 10^{-5}$ > | $1.3 \times 10^{-5}$ | $4.0 \times 10^{6}$ |
| | 150 V | N | Y | $2.7 \times 10^{-5}$ > | $1.3 \times 10^{-5}$ | $4.0 \times 10^{6}$ |
| | 200 V | N | Y | $2.5 \times 10^{-5}$ > | $1.3 \times 10^{-5}$ | $4.0 \times 10^{6}$ |
| $3.0 \times 10^{-2}$ | 50 V | Y | Y | $3.0 \times 10^{-5}$ > | $8.3 \times 10^{-6}$ | $4.0 \times 10^{6}$ |
| c/k g | 100 V | (Y) | Y | $2.8 \times 10^{-5}$ > | $8.3 \times 10^{-6}$ | $4.0 \times 10^{6}$ |
| | 150 V | N | Y | $2.7 \times 10^{-5}$ > | $8.3 \times 10^{-6}$ | $4.0 \times 10^{6}$ |
| | 200 V | N | Y | $2.5 \times 10^{-5}$ > | $8.3 \times 10^{-6}$ | $4.0 \times 10^{6}$ |

Vf = 2000 [kHz] Vpp = 2000 [V]: CONSTANT
S-D gap (d) = 500 $\mu$m

As for the evaluative reference, a reference Y means that the positive ghost could be visually observed; N, that the positive ghost could not be observed visually; and (Y) means that an extremely light positive ghost occurred. As for the evaluative reference for the density change in the low density area, a reference Y means that when the initial image density was 0.5, the density change was no less than 0.1 after the continuous passage of 100 sheets; an N means that it was no more than 0.1.

Figure 9:
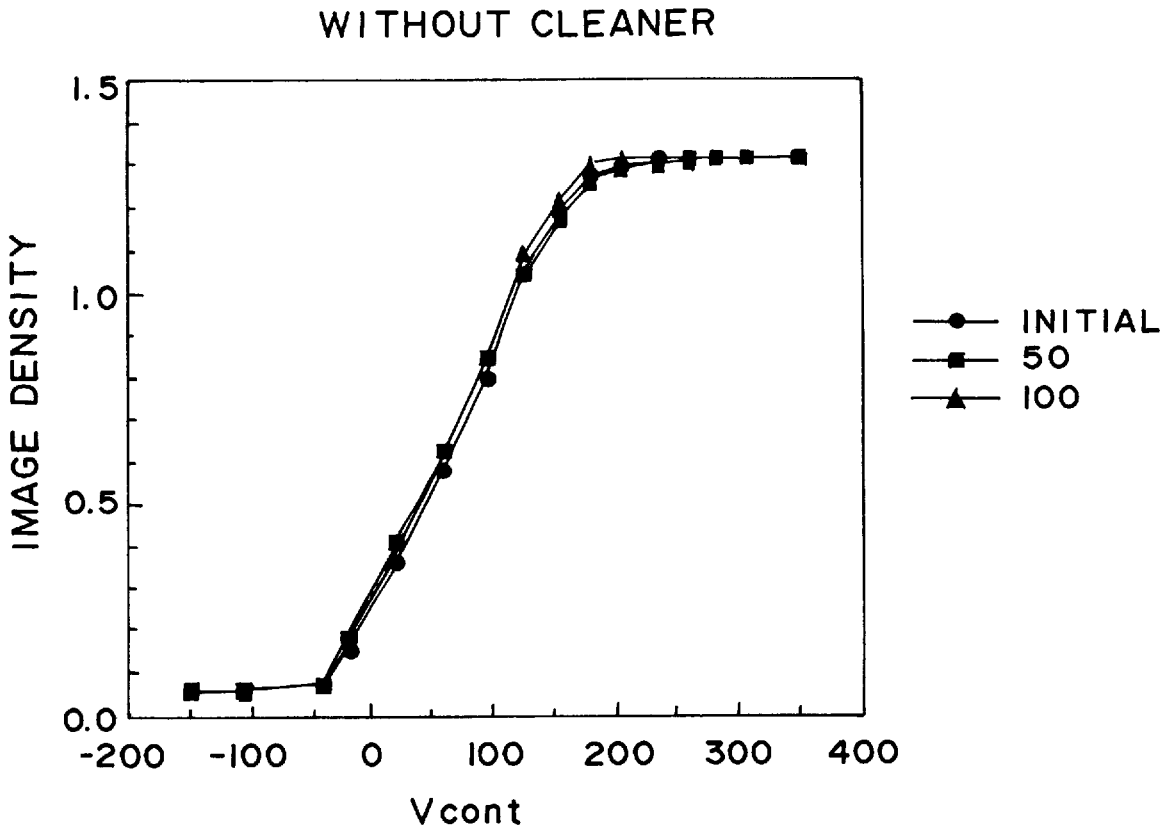
FIG. 9 is a graph showing examples of density change caused by the developing bias which is in accordance with the conditions of the present invention.

FIG. 9 shows examples of the density change that occurred when the developing bias in accordance with the conditions of the present invention was used, wherein the density change was suppressed to 0.07.

As is evident from the results presented in Tables 5–7, in this embodiment, the positive ghost did not occur, as it did not in Embodiment 1, when the relationship between A and B satisfied the inequality, A<B. Also in this embodiment, the positive ghost sometimes did not occur even when A>B. However, the density change occurred when A>B. As for the relationship between the electric field strength and the positive ghost, the occurrence of the positive ghost could be prevented when the inequity, $V_{pp}/d > 1 \times 10^6$ (V/m), was satisfied.

As is evident from the above description, when the toner produced using the polymerizing method is recovered at the same time as the image is developed, the occurrences of both the positive ghost and the density change can be prevented by applying to the developing sleeve the developing bias which is in accordance with the following conditions.

$$\frac{|Vpp - 2Vback|}{16Vf^2} < \frac{d^2}{|Q|} \text{ and } Vpp/d > 1 \times 10^5 \text{ (V/m)}$$

Embodiment 3

In Embodiments 1 and 2, evaluation was made with a fixed gap of 500 $\mu$m between the photosensitive drum and developing sleeve, whereas in this embodiment, the evaluation was made setting the gap at 300 $\mu$m and 800 $\mu$m. When the gap was set at 300 $\mu$m, the electric field strengthened, and when set at 800 $\mu$m, the electric field weakened. Also in this embodiment, the same two-component developer as-the one used in Embodiment 1 was used, which was composed of the toner and magnetic carrier, wherein the toner was produced by the pulverizing method, containing the additive of titanium oxide by 1 wt %, and the carrier had a saturation magnetization level of 205 emu/cm$^3$. The average particle diameters were 8 $\mu$m for the toner, 50 $\mu$m for the carrier, and 20 nm for the titanium oxide. (As for the mixing ratio by weight, the nonmagnetic toner occupied approximately 5%.)

Also, the structure or operation of the apparatus was the same as Embodiment 1. Tables 8–11 correspond to evaluations made: when the alternating voltage frequency $V_f$ was varied with the gap being fixed at 300 $\mu$m; when the peak-to-peak voltage $V_{pp}$ was varied with the gap being fixed at 300 $\mu$m; the frequency $V_f$ was varied with the gap being fixed at 800 $\mu$m; and when the peak-to-peak voltage $V_{pp}$ was varied with the gap being fixed at 800 $\mu$m.

As for the evaluation reference, a reference Y means that the positive ghost could be visually observed; N, that the positive ghost could not be observed visually; and (Y) means that an extremely light positive ghost occurred.

The results are given in Tables 8–11.

TABLE 8

| TRIBO-ELECTRIC CHARGE | Vf | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ c/kg | 1000 HZ | Y | $1.1 \times 10^{-4}$ > | $4.5 \times 10^{-6}$ | $6.7 \times 10^{6}$ |
| | 2000 HZ | Y | $2.7 \times 10^{-5}$ > | $4.5 \times 10^{-6}$ | $6.7 \times 10^{6}$ |
| | 4000 HZ | Y | $6.6 \times 10^{-6}$ > | $4.5 \times 10^{-6}$ | $6.7 \times 10^{6}$ |
| | 8000 HZ | N | $1.7 \times 10^{-6}$ < | $4.5 \times 10^{-6}$ | $6.7 \times 10^{6}$ |
| $3.0 \times 10^{-2}$ c/kg | 1000 HZ | Y | $1.1 \times 10^{-4}$ > | $3.0 \times 10^{-6}$ | $6.7 \times 10^{6}$ |
| | 2000 HZ | Y | $2.7 \times 10^{-5}$ > | $3.0 \times 10^{-6}$ | $6.7 \times 10^{6}$ |
| | 4000 HZ | Y | $6.6 \times 10^{-6}$ > | $3.0 \times 10^{-6}$ | $6.7 \times 10^{6}$ |
| | 8000 HZ | N | $1.7 \times 10^{-6}$ < | $3.0 \times 10^{-6}$ | $6.7 \times 10^{6}$ |

Vpp = 2000 ⌈V⌋ Vback = 150 ⌈V⌋: CONSTANT
S-D gap (d) = 300 $\mu$m

TABLE 9

| TRIBO-ELECTRIC CHARGE | Vpp | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ c/kg | 500 V | Y | $7.8 \times 10^{-7}$ < | $4.5 \times 10^{-6}$ | $1.7 \times 10^{6}$ |
| | 1000 V | N | $2.7 \times 10^{-6}$ < | $4.5 \times 10^{-6}$ | $3.3 \times 10^{6}$ |
| | 1500 V | Y | $4.7 \times 10^{-6}$ > | $4.5 \times 10^{-6}$ | $5.0 \times 10^{6}$ |
| | 2000 V | Y | $6.6 \times 10^{-6}$ > | $4.5 \times 10^{-6}$ | $6.7 \times 10^{6}$ |
| $3.0 \times 10^{-2}$ c/kg | 500 V | Y | $7.8 \times 10^{-7}$ < | $3.0 \times 10^{-6}$ | $1.7 \times 10^{6}$ |
| | 1000 V | N | $2.7 \times 10^{-6}$ < | $3.0 \times 10^{-6}$ | $3.3 \times 10^{6}$ |
| | 1500 V | Y | $4.7 \times 10^{-6}$ > | $3.0 \times 10^{-6}$ | $5.0 \times 10^{6}$ |
| | 2000 V | Y | $6.6 \times 10^{-6}$ > | $3.0 \times 10^{-6}$ | $6.7 \times 10^{6}$ |

Vf = 4000 ⌈kHZ⌋ Vback = 150 ⌈V⌋: CONSTANT
S-D gap (d) = 300 $\mu$m

TABLE 10

| TRIBO-ELECTRIC CHARGE | Vf | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ c/kg | 1000 HZ | Y | $1.1 \times 10^{-4}$ > | $3.2 \times 10^{-5}$ | $2.5 \times 10^{6}$ |
| | 2000 HZ | N | $2.7 \times 10^{-5}$ < | $3.2 \times 10^{-5}$ | $2.5 \times 10^{6}$ |
| | 4000 HZ | N | $6.6 \times 10^{-6}$ < | $3.2 \times 10^{-5}$ | $2.5 \times 10^{6}$ |
| | 8000 HZ | N | $1.7 \times 10^{-6}$ < | $3.2 \times 10^{-5}$ | $2.5 \times 10^{6}$ |
| $3.0 \times 10^{-2}$ c/kg | 1000 HZ | Y | $1.1 \times 10^{-4}$ > | $2.1 \times 10^{-5}$ | $2.5 \times 10^{6}$ |
| | 2000 HZ | N | $2.7 \times 10^{-5}$ < | $2.1 \times 10^{-5}$ | $2.5 \times 10^{6}$ |
| | 4000 HZ | N | $6.6 \times 10^{-6}$ < | $2.1 \times 10^{-5}$ | $2.5 \times 10^{6}$ |
| | 8000 HZ | N | $1.7 \times 10^{-6}$ < | $2.1 \times 10^{-5}$ | $2.5 \times 10^{6}$ |

Vpp = 2000 ⌈V⌋ Vback = 150 ⌈V⌋: CONSTANT
S-D gap (d) = 800 $\mu$m

TABLE 11

| TRIBO-ELECTRIC CHARGE | Vpp | POSITIVE GHOST | A $\frac{\lvert Vpp - 2\ V\ back\rvert}{16\ Vf^2}$ | B $\frac{d^2}{Q}$ | Vpp/d |
|---|---|---|---|---|---|
| $2.0 \times 10^{-2}$ c/kg | 500 V | Y | $7.8 \times 10^{-7}$ < | $3.2 \times 10^{-5}$ | $6.2 \times 10^{5}$ |
| | 1000 V | Y | $2.7 \times 10^{-6}$ < | $3.2 \times 10^{-5}$ | $1.3 \times 10^{6}$ |
| | 1500 V | (Y) | $4.7 \times 10^{-6}$ < | $3.2 \times 10^{-5}$ | $1.9 \times 10^{6}$ |
| | 2000 V | N | $6.6 \times 10^{-6}$ < | $3.2 \times 10^{-5}$ | $2.5 \times 10^{6}$ |
| $3.0 \times 10^{-2}$ c/kg | 500 V | Y | $7.8 \times 10^{-7}$ < | $2.1 \times 10^{-5}$ | $6.2 \times 10^{5}$ |
| | 1000 V | Y | $2.7 \times 10^{-6}$ < | $2.1 \times 10^{-5}$ | $1.3 \times 10^{6}$ |
| | 1500 V | (Y) | $4.7 \times 10^{-6}$ < | $2.1 \times 10^{-5}$ | $1.9 \times 10^{6}$ |
| | 2000 V | N | $6.6 \times 10^{-6}$ < | $2.1 \times 10^{-5}$ | $2.5 \times 10^{6}$ |

Vf = 4000 ⌈kHZ⌋ Vback = 150 ⌈V⌋: CONSTANT
S-D gap (d) = 800 $\mu$m

As is evident from Tables 8–11, when the toner produced by the pulverizing method is used, a preferable image suffering from no positive ghost can be obtained, regardless of the gap between the photosensitive drum and developing sleeve, by applying the developing bias which is in accordance with the following condition, to the developing sleeve while the residual toner is recovered at the same time as the image is developed.

$$\frac{|Vpp - 2Vback|}{16Vf^2} < \frac{d^2}{|Q|} \text{ and } Vpp/d > 2 \times 10^8 \text{ (V/m)}$$

Embodiment 4

In Embodiments 1 and 2, evaluation was made with the gap between the photosensitive drum and developing sleeve being fixed at 500 μm, whereas in this embodiment, the evaluation was made setting the gap at 300 μm and 800 μm. When the gap was set at 300 μm, the electric field strengthened, and when set at 800 μm, the electric field weakened. Also in this embodiment, the same two-component developer as the one used in Embodiment 1 was used, which was composed of the toner and magnetic carrier, wherein the toner was produced by the pulverizing method, containing the additive of titanium oxide by 1 wt %, and the carrier had a saturation magnetization level of 205 emu/cm$^3$.

The average particle diameters were 8 μm for the toner, 50 μm for the carrier, and 20 nm for the titanium oxide. (As for the mixing ratio by weight, the nonmagnetic toner occupied approximately 5%.)

Also, the structure or operation of the apparatus was the same as Embodiment 1. Tables 12–15 correspond to evaluations of the occurrences of the positive ghost and density change, which were made: when the alternating voltage frequency $V_f$ was varied with the gap being fixed at 300 μm; when the peak-to-peak voltage $V_{pp}$ was varied with the gap being fixed at 300 μm; the frequency $V_f$ was varied with the gap being fixed at 800 μm; and when the peak-to-peak voltage $V_{pp}$ was varied with the gap being fixed at 800 μm.

As for the evaluative reference, a reference Y means that the positive ghost could be visually observed; N, that the positive ghost could not be observed visually; and (Y) means that an extremely light positive ghost occurred.

The results are given in Tables 12–15.

TABLE 12

| TRIBO-ELECTRIC CHARGE | Vf | POSITIVE GHOST | DENSITY CHANGE | A $\frac{\lvert Vpp - 2\,Vback}{16\,Vf^2\rvert}$ | B $\frac{d^2}{Q}$ | Vpp/d |
|---|---|---|---|---|---|---|
| $2.0 \times 10^{-2}$ | 1000 HZ | Y | Y | $1.1 \times 10^{-5}$ > | $4.5 \times 10^{-6}$ | $6.7 \times 10^{6}$ |
| c/k g | 2000 HZ | (Y) | Y | $2.7 \times 10^{-5}$ > | $4.5 \times 10^{-6}$ | $6.7 \times 10^{6}$ |
| | 4000 HZ | N | Y | $6.6 \times 10^{-6}$ > | $4.5 \times 10^{-6}$ | $6.7 \times 10^{6}$ |
| | 8000 HZ | N | N | $1.7 \times 10^{-6}$ < | $4.5 \times 10^{-6}$ | $6.7 \times 10^{6}$ |
| $3.0 \times 10^{-2}$ | 1000 HZ | Y | Y | $1.1 \times 10^{-4}$ > | $3.0 \times 10^{-6}$ | $6.7 \times 10^{6}$ |
| c/k g | 2000 HZ | (Y) | Y | $2.7 \times 10^{-5}$ > | $3.0 \times 10^{-6}$ | $6.7 \times 10^{6}$ |
| | 4000 HZ | N | Y | $6.6 \times 10^{-6}$ > | $3.0 \times 10^{-6}$ | $6.7 \times 10^{6}$ |
| | 8000 HZ | N | N | $1.7 \times 10^{-6}$ < | $3.0 \times 10^{-6}$ | $6.7 \times 10^{6}$ |

Vpp = 2000 [V] Vback = 150 [V]: CONSTANT
S-D gap (d) = 300 μm

TABLE 13

| TRIBO-ELECTRIC CHARGE | Vpp | POSITIVE GHOST | DENSITY CHANGE | A $\frac{\lvert Vpp - 2\,Vback}{16\,Vf^2\rvert}$ | B $\frac{d^2}{Q}$ | Vpp/d |
|---|---|---|---|---|---|---|
| $2.0 \times 10^{-2}$ | 250 V | (Y) | N | $7.8 \times 10^{-7}$ < | $4.5 \times 10^{-6}$ | $8.3 \times 10^{5}$ |
| c/k g | 500 V | N | N | $3.1 \times 10^{-6}$ < | $4.5 \times 10^{-6}$ | $1.7 \times 10^{6}$ |
| | 750 V | N | N | $7.0 \times 10^{-6}$ < | $4.5 \times 10^{-6}$ | $2.5 \times 10^{6}$ |
| | 1000 V | (Y) | Y | $1.1 \times 10^{-5}$ > | $4.5 \times 10^{-6}$ | $3.3 \times 10^{6}$ |
| $3.0 \times 10^{-2}$ | 250 V | (Y) | N | $7.8 \times 10^{-7}$ < | $3.0 \times 10^{-6}$ | $8.3 \times 10^{5}$ |
| c/k g | 500 V | N | N | $3.1 \times 10^{-6}$ < | $3.0 \times 10^{-6}$ | $1.7 \times 10^{6}$ |
| | 750 V | N | N | $7.0 \times 10^{-6}$ < | $3.0 \times 10^{-6}$ | $2.5 \times 10^{6}$ |
| | 1000 V | (Y) | Y | $1.1 \times 10^{-5}$ > | $3.0 \times 10^{-6}$ | $3.3 \times 10^{6}$ |

Vf = 2000 [kHz] Vback = 150 [V]: CONSTANT
S-D gap (d) = 300 μm

TABLE 14

| TRIBO-ELECTRIC CHARGE | Vf | POSITIVE GHOST | DENSITY CHANGE | A $\frac{\lvert Vpp - 2\,Vback}{16\,Vf^2\rvert}$ | B $\frac{d^2}{Q}$ | Vpp/d |
|---|---|---|---|---|---|---|
| $2.0 \times 10^{-2}$ | 1000 HZ | Y | Y | $1.1 \times 10^{-4}$ > | $3.2 \times 10^{-5}$ | $2.5 \times 10^{6}$ |
| c/k g | 2000 HZ | N | N | $2.7 \times 10^{-5}$ < | $3.2 \times 10^{-5}$ | $2.5 \times 10^{6}$ |
| | 4000 HZ | N | N | $6.6 \times 10^{-6}$ < | $3.2 \times 10^{-5}$ | $2.5 \times 10^{6}$ |
| | 8000 HZ | N | N | $1.7 \times 10^{-6}$ < | $3.2 \times 10^{-5}$ | $2.5 \times 10^{6}$ |
| $3.0 \times 10^{-2}$ | 1000 HZ | Y | Y | $1.1 \times 10^{-4}$ > | $2.1 \times 10^{-5}$ | $2.5 \times 10^{6}$ |

TABLE 14-continued

| TRIBO-ELECTRIC CHARGE | Vf | POSITIVE GHOST | DENSITY CHANGE | A $\frac{\lvert Vpp - 2\,Vback}{16\,Vf^2\rvert}$ | B $\frac{d^2}{Q}$ | Vpp/d |
|---|---|---|---|---|---|---|
| c/k g | 2000 HZ | N | Y | $2.7 \times 10^{-5}$ > | $2.1 \times 10^{-5}$ | $2.5 \times 10^{6}$ |
| | 4000 HZ | N | N | $6.6 \times 10^{-6}$ < | $2.1 \times 10^{-5}$ | $2.5 \times 10^{6}$ |
| | 8000 HZ | N | N | $1.7 \times 10^{-6}$ < | $2.1 \times 10^{-5}$ | $2.5 \times 10^{6}$ |

Vpp = 2000 [V] Vback = 150 [V]: CONSTANT
S-D gap (d) = 800 $\mu$m

TABLE 15

| TRIBO-ELECTRIC CHARGE | Vpp | POSITIVE GHOST | DENSITY CHANGE | A $\frac{\lvert Vpp - 2\,Vback}{16\,Vf^2\rvert}$ | B $\frac{d^2}{Q}$ | Vpp/d |
|---|---|---|---|---|---|---|
| $2.0 \times 10^{-2}$ | 250 V | Y | N | $7.8 \times 10^{-7}$ < | $3.2 \times 10^{-5}$ | $3.1 \times 10^{5}$ |
| c/k g | 500 V | (Y) | N | $3.1 \times 10^{-6}$ < | $3.2 \times 10^{-5}$ | $6.3 \times 10^{5}$ |
| | 750 V | (Y) | N | $7.0 \times 10^{-6}$ < | $3.2 \times 10^{-5}$ | $9.4 \times 10^{5}$ |
| | 1000 V | N | N | $1.1 \times 10^{-5}$ < | $3.2 \times 10^{-5}$ | $1.3 \times 10^{6}$ |
| $3.0 \times 10^{-2}$ | 250 V | Y | N | $7.8 \times 10^{-7}$ < | $2.1 \times 10^{-5}$ | $3.1 \times 10^{5}$ |
| c/k g | 500 V | (Y) | N | $3.1 \times 10^{-6}$ < | $2.1 \times 10^{-5}$ | $6.3 \times 10^{5}$ |
| | 750 V | (Y) | N | $7.0 \times 10^{-6}$ < | $2.1 \times 10^{-5}$ | $9.4 \times 10^{5}$ |
| | 1000 V | N | N | $1.1 \times 10^{-5}$ < | $2.1 \times 10^{-5}$ | $1.3 \times 10^{6}$ |

Vf = 2000 [kHz] Vback = 150 [V]: CONSTANT
S-D gap (d) = 800 $\mu$m

As is evident from Tables 12–15, when the toner produced by the pulverizing method is used, a preferable image suffering from no positive ghost, and/or the density change that occurs in the low density area during the continuous sheet passage, can be obtained, regardless of the gap between the photosensitive drum and developing sleeve, by applying the developing bias in accordance with the following condition to the developing sleeve while the residual toner is recovered at the same time as the image is developed.

$$\frac{|Vpp - 2Vback|}{16Vf^2} < \frac{d^2}{|Q|} \text{ and } Vpp/d > 1 \times 10^6 \text{ (V/m)}$$

Embodiment 5

Figure 10:
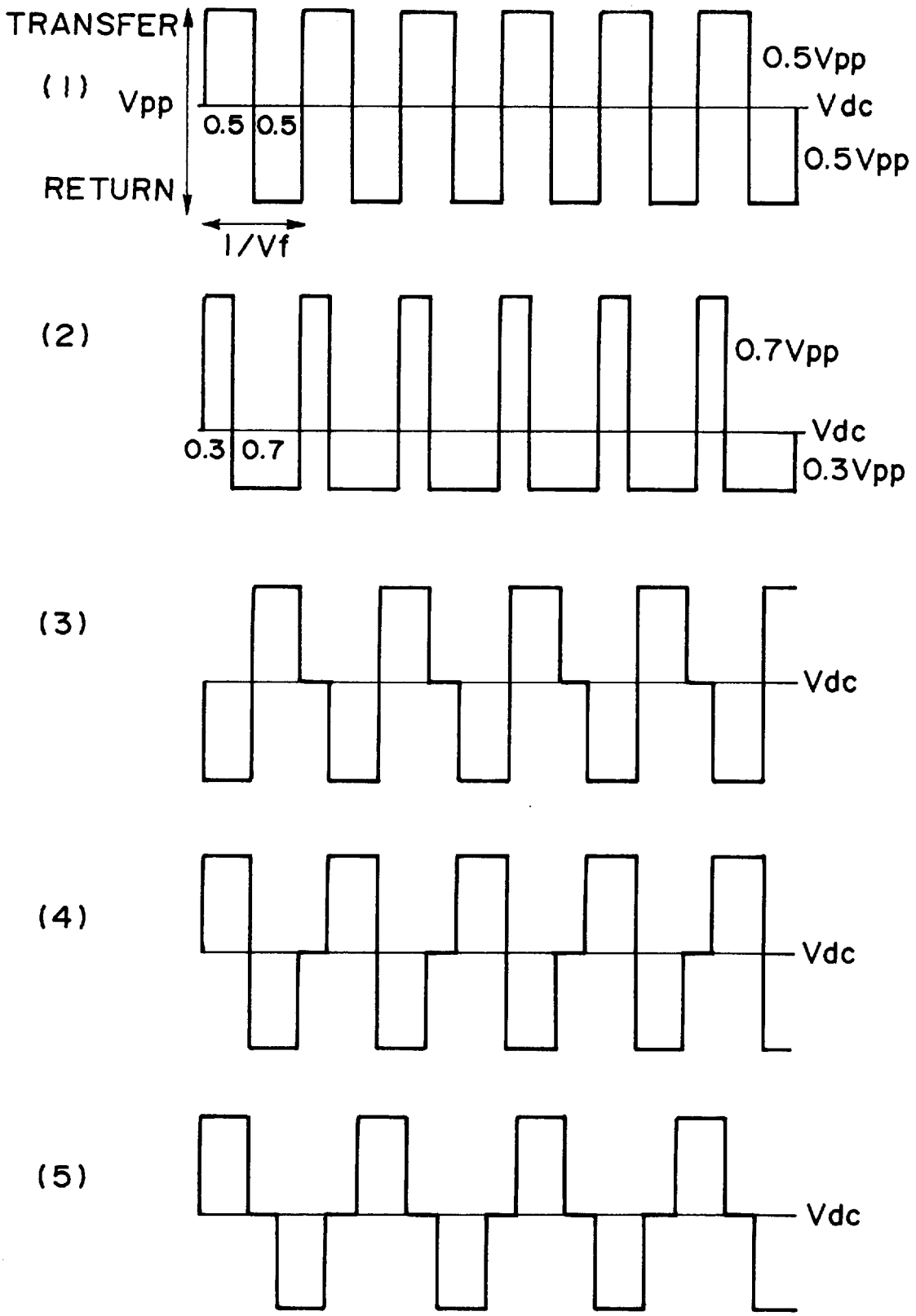
FIG. 10 depicts the developing bias waveform in each of the embodiments of the present invention.

In this embodiment, a case depicted by FIG. 10(1) was studied, in which the alternating voltage application length was the same for the transfer side and return side.

When the temporal ratio S of the alternating voltage application on the transfer side is fixed at 0.5, the transfer and return sides of the alternating voltage are applied, for a duration of $0.5/V_f$ second per alternating voltage cycle, to the residual toner on the electrostatic latent image portion in the white background area. The distance X the toner can travel during this period is expressed by the following formula:

$$X = \frac{1}{2}\, a \left(\frac{0.5}{Vf}\right)^2 = \frac{1}{2}\left(\frac{|q|}{m}\ \frac{\Delta V}{d}\right)\frac{(0.5)^2}{Vf^2} = \frac{(0.5)^2|Q|}{2d}\ \frac{\Delta V}{Vf^2}$$

Transfer side (developing sleeve photosensitive drum direction)

$$X_+ = \frac{(0.5)^2|Q|}{2d}\ \frac{|0.5Vpp - Vback|}{Vf^2}$$

Return side (photosensitive drum developing sleeve direction)

$$X_- = \frac{(0.5)^2|Q|}{2d}\ \frac{|0.5Vpp + Vback|}{Vf^2}$$

The residual toner stripped from the electrostatic latent image portion in the white background area surely reaches the developing sleeve since $X_+ < X_-$, as described hereinbefore in Embodiment 1. Therefore, when the following conditions under which X+ becomes smaller than the gap d between the photosensitive drum and developing sleeve are established, the residual toner having once reached the developing sleeve collects on the developing side, being oscillated without returning to the photosensitive drum side. (This is because $X_+ < X_-$.)

$$\frac{(0.5)^2|Q|}{2d}\ \frac{|0.5Vpp - Vback|}{Vf^2} < d \rightarrow \frac{(0.5)^2}{2}\ \frac{|0.5Vpp - Vback|}{Vf^2} < \frac{d^2}{|Q|}$$

Further, under the above conditions, X+ becomes larger than X−; therefore, the distance X the toner travels when the stripping voltage is applied for a duration of a single cycle is not long enough for the toner having transferred onto the image portion of the photosensitive drum to return to the developing sleeve; therefore, the toner collects on the photosensitive drum side, being oscillated thereon.

As a result, the toner jumps in such a manner as to concentrate onto the electrostatic image having formed on the photosensitive drum, improving thereby the image quality.

Tables 16–19 represent the results obtained through the studies of the aforementioned conditions, and correspond to:

when the frequency $V_f$ of the alternating voltage was varied; when the peak-to-peak voltage $V_{pp}$ was varied; when the $V_{back}$ was varied with the $V_f$ being fixed at 2 kHz; and when the $V_{back}$ was varied with the $V_f$ being fixed at 4 kHz.

TABLE 16

| TRIBO-ELECTRIC CHARGE | Vf | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 1000 HZ | Y | $1.1 \times 10^{-4}$> | $1.3 \times 10^{-5}$ | $2.3 \times 10^{6}$ |
| | 2000 HZ | Y | $2.7 \times 10^{-5}$> | $1.3 \times 10^{-5}$ | $2.3 \times 10^{6}$ |
| | 4000 HZ | N | $6.6 \times 10^{-6}$< | $1.3 \times 10^{-5}$ | $2.3 \times 10^{6}$ |
| | 8000 HZ | N | $1.7 \times 10^{-6}$< | $1.3 \times 10^{-5}$ | $2.3 \times 10^{6}$ |
| $3.0 \times 10^{-2}$ c/kg | 1000 HZ | Y | $1.1 \times 10^{-4}$> | $8.3 \times 10^{-6}$ | $2.3 \times 10^{6}$ |
| | 2000 HZ | Y | $2.7 \times 10^{-5}$> | $8.3 \times 10^{-6}$ | $2.3 \times 10^{6}$ |
| | 4000 HZ | N | $6.6 \times 10^{-6}$< | $8.3 \times 10^{-6}$ | $2.3 \times 10^{6}$ |
| | 8000 HZ | N | $1.7 \times 10^{-6}$< | $8.3 \times 10^{-6}$ | $2.3 \times 10^{6}$ |

Vpp = 2000 ⌈V⌋ Vback = 150 ⌈V⌋: CONSTANT
S-D gap (d) = 500 μm

TABLE 17

| TRIBO-ELECTRIC CHARGE | Vpp | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 500 V | Y | $7.8 \times 10^{-7}$< | $1.3 \times 10^{-5}$ | $8.0 \times 10^{5}$ |
| | 1000 V | N | $2.7 \times 10^{-4}$< | $1.3 \times 10^{-5}$ | $1.3 \times 10^{6}$ |
| | 1500 V | N | $4.7 \times 10^{-6}$< | $1.3 \times 10^{-5}$ | $1.8 \times 10^{6}$ |
| | 2000 V | N | $6.6 \times 10^{-6}$< | $1.3 \times 10^{-5}$ | $2.3 \times 10^{6}$ |
| $3.0 \times 10^{-2}$ c/kg | 500 V | Y | $7.8 \times 10^{-7}$< | $8.3 \times 10^{-6}$ | $8.0 \times 10^{5}$ |
| | 1000 V | N | $2.7 \times 10^{-6}$< | $8.3 \times 10^{-6}$ | $1.3 \times 10^{6}$ |
| | 1500 V | N | $4.7 \times 10^{-6}$< | $8.3 \times 10^{-6}$ | $1.8 \times 10^{6}$ |
| | 2000 V | N | $6.6 \times 10^{-6}$< | $8.3 \times 10^{-6}$ | $2.3 \times 10^{6}$ |

Vf = 4000 ⌈kHZ⌋ Vback = 150 ⌈V⌋: CONSTANT
S-D gap (d) = 500 μm

TABLE 18

| TRIBO-ELECTRIC CHARGE | Vback | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 50 V | Y | $3.0 \times 10^{-5}$> | $1.3 \times 10^{-5}$ | $2.1 \times 10^{4}$ |
| | 100 V | Y | $2.8 \times 10^{-5}$> | $1.3 \times 10^{-5}$ | $2.2 \times 10^{6}$ |
| | 150 V | Y | $2.7 \times 10^{-5}$> | $1.3 \times 10^{-5}$ | $2.3 \times 10^{6}$ |
| | 200 V | Y | $2.5 \times 10^{-5}$> | $1.3 \times 10^{-5}$ | $2.4 \times 10^{6}$ |
| $3.0 \times 10^{-2}$ c/kg | 50 V | Y | $3.0 \times 10^{-3}$> | $8.3 \times 10^{-6}$ | $2.1 \times 10^{6}$ |
| | 100 V | Y | $2.8 \times 10^{-5}$> | $8.3 \times 10^{-6}$ | $2.2 \times 10^{6}$ |
| | 150 V | Y | $2.7 \times 10^{-5}$> | $8.3 \times 10^{-6}$ | $2.3 \times 10^{6}$ |
| | 200 V | Y | $2.5 \times 10^{-5}$> | $8.3 \times 10^{-6}$ | $2.4 \times 10^{6}$ |

Vpp = 2000 ⌈V⌋ Vf = 2000 ⌈kHz⌋: CONSTANT
S-D gap (d) = 500 μm

TABLE 19

| TRIBO ELECTRIC CHARGE | Vback | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 50 V | N | $7.4 \times 10^{-6}$< | $1.3 \times 10^{-5}$ | $2.1 \times 10^{6}$ |
| | 100 V | N | $7.0 \times 10^{-6}$< | $1.3 \times 10^{-5}$ | $2.2 \times 10^{4}$ |
| | 150 V | N | $6.6 \times 10^{-4}$< | $1.3 \times 10^{-5}$ | $2.3 \times 10^{6}$ |
| | 200 V | N | $6.3 \times 10^{-6}$< | $1.3 \times 10^{-5}$ | $2.4 \times 10^{6}$ |
| $3.0 \times 10^{-2}$ c/kg | 50 V | N | $7.4 \times 10^{-6}$< | $8.3 \times 10^{-6}$ | $2.1 \times 10^{6}$ |
| | 100 V | N | $7.0 \times 10^{-6}$< | $8.3 \times 10^{-4}$ | $2.2 \times 10^{6}$ |
| | 150 V | N | $6.6 \times 10^{-6}$< | $8.3 \times 10^{-4}$ | $2.3 \times 10^{6}$ |
| | 200 V | N | $6.3 \times 10^{-6}$< | $8.3 \times 10^{-6}$ | $2.4 \times 10^{6}$ |

Vpp = 2000 ⌈V⌋ Vf = 4000 ⌈kHz⌋: CONSTANT
S-D gap (d) = 500 μm

As for the evaluative reference, a reference Y designates a case in which the positive ghost could be visually observed; N, a case in which the positive ghost could not be observed visually; and (Y) designates a case in which an extremely light positive ghost occurred.

As is evident from Tables 16–19, with the relationship between A and P being: A<B, the occurrence of the positive ghost can be prevented when a condition, $(0.5 \cdot V_{pp}+V_{back})/d>1\times10^6$ (V/m), is satisfied, wherein $(0.5 \cdot V_{pp}+V_{back})/d$ is equivalent to the magnitude of the electric field which is generated between the photosensitive drum and developing sleeve in the direction of returning the toner. Unless the strength of this electric field is larger than a certain level, the toner cannot be stripped from the photosensitive drum. The relation, A<B, means that the residual toner having reached the developing sleeve does not return to the photosensitive drum, as it did not in Embodiment 1. In other words, the above two formulas mean that the residual toner on the electrostatic latent image portion in the white background area is stripped from the photosensitive drum and does not return to the photosensitive drum.

As described above, when the developing bias satisfying the following conditions is applied to the developing sleeve to recover the residual toner at the same time as the image is developed, the residual toner on the electrostatic image portion in the white background area is stripped from the photosensitive drum and never returns thereto; therefore, a preferable image suffering from no positive ghost can be produced.

$$\frac{(0.5)^2|0.5Vpp - Vback|}{2Vf^2} < \frac{d^2}{|Q|}$$

and $(0.5 \cdot Vpp + Vback)/d > 1 \times 10^6$ (V/m)

Embodiment 6

The toner of the two-component developer used in Embodiment 5 was manufactured using a pulverizing method. Its average particle diameter was 8 μm, and contained the additive of titanium oxide, by 1 wt %. The average particle diameter of the titanium oxide was 20 nm. However, in this embodiment, spherical toner manufactured using the polymerizing method was used. It also contained the additive, titanium oxide, by 1 wt %, the average diameter of which was also 20 nm. The toner produced using the polymerizing method is substantially spherical; therefore, it is uniformly coated with the additive, which offers superior separative properties relative to the photosensitive drum. For example, when the transfer efficiency (amount of the toner transferred onto a sheet of paper per unit area) was compared between the two types of toner produced by the pulverization and polymerization, respectively, it was 90% for the pulverized toner, whereas it was 97% for the polymerized toner, being much higher. The polymerized toner was more preferable with regard to tog prevention than the pulverized toner, wherein when the polymerized toner was used, the fog could be prevented even when $V_{back}$=50V.

As is evident from the above description, when the polymerized toner is used, the amount of the residual toner is extremely small. Also, the polymerized toner displays high separativeness; therefore, when it is used in conjunction with a cleaner less structure which recovers the residual toner during the developing process, recovery efficiency improves. Consequently, the occurrence of the fog is virtually eliminated.

Figure 11:
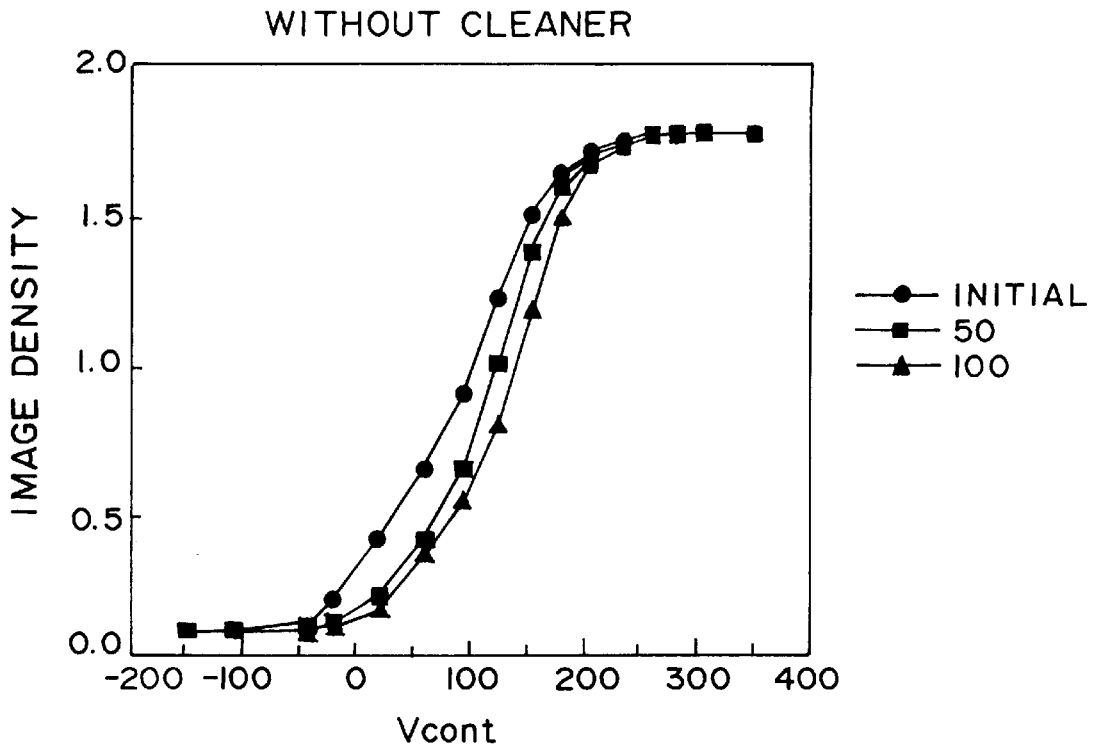
FIG. 11 is a graph showing the image density change that occurs during continuous sheet passage.
Figure 12:
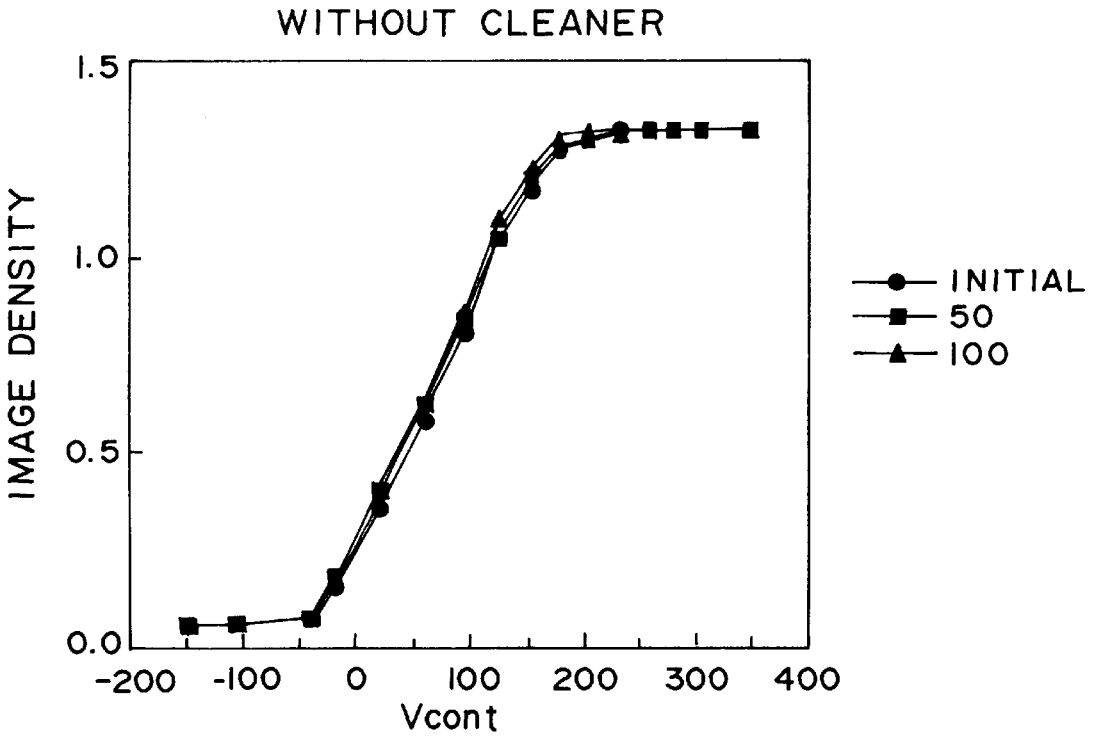
FIG. 12 is a graph showing examples of the density change caused by the developing bias.

However, when sheets were continuously fed while using the polymerized toner in conjunction with a cleanerless system, the image density in the low density area gradually declined as shown in FIG. 11. In FIG. 11, a reference ● indicates the image density for the initial contrast; ■, the image density for the contrast after the continuous passage of 50 sheets; and a black triangular reference Δ designates the image density for the contrast after the continuous passage of 100 sheets. As the results of the study of this phenomenon, it has been revealed that this phenomenon occurs as the additive titanium oxide accumulates on the photosensitive drum. More specifically, as the additive accumulated on the drum surface, the separativeness further improved; therefore, the toner was stripped by the alternating voltage on the downstream side of the developing station.

Thus, in this embodiment, it was checked whether or not the positive ghost occurred, while varying the bias applied during the developing process as it was in Embodiment 1, and also, the density change in the low density area was evaluated. Also, in this embodiment, the case in which the duration of the application time is the same for the transfer and recovery sides as depicted by FIG. 10(1) was studied. Tables 20–22 correspond to: when the frequency $V_f$ of the alternating voltage was varied; when the peak-to-peat voltage of the alternating voltage was varied; and when $V_{back}$ was varied.

TABLE 20

| TRIBO-ELECTRIC CHARGE | Vf | POSITIVE GHOST | DENSITY CHANGE | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|---|
| $2.0 \times 10^{-2}$ | 1000 HZ | Y | Y | $1.2 \times 10^{-4}$> | $1.3 \times 10^{-5}$ | $2.1 \times 10^{6}$ |
| c/kg | 2000 HZ | N | Y | $3.0 \times 10^{-5}$> | $1.3 \times 10^{-5}$ | $2.1 \times 10^{6}$ |
| | 4000 HZ | N | N | $7.4 \times 10^{-6}$< | $1.3 \times 10^{-5}$ | $2.1 \times 10^{6}$ |
| | 8000 HZ | N | N | $1.9 \times 10^{-6}$< | $1.3 \times 10^{-5}$ | $2.1 \times 10^{6}$ |
| $3.0 \times 10^{-2}$ | 1000 HZ | Y | Y | $1.2 \times 10^{-6}$> | $8.3 \times 10^{-6}$ | $2.1 \times 10^{6}$ |
| c/kg | 2000 HZ | N | Y | $3.0 \times 10^{-5}$> | $8.3 \times 10^{-6}$ | $2.1 \times 10^{6}$ |
| | 4000 HZ | N | N | $7.4 \times 10^{-6}$< | $8.3 \times 10^{-6}$ | $2.1 \times 10^{6}$ |
| | 8000 HZ | N | N | $1.9 \times 10^{-6}$< | $8.3 \times 10^{-6}$ | $2.1 \times 10^{6}$ |

Vpp = 3000 ⌈V⌋ Vback = 50 ⌈V⌋: CONSTANT

S-D gap (d) = 500 μm

TABLE 21

| TRIBO-ELECTRIC CHARGE | Vpp | POSITIVE GHOST | DENSITY CHANGE | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|---|
| $2.0 \times 10^{-2}$ c/kg | 250 V | (Y) | N | $2.3 \times 10^{-6}$< | $1.3 \times 10^{-5}$ | $3.5 \times 10^{5}$ |
| | 500 V | N | N | $6.3 \times 10^{-6}$< | $1.3 \times 10^{-5}$ | $6.0 \times 10^{5}$ |
| | 750 V | N | N | $1.0 \times 10^{-5}$< | $1.3 \times 10^{-5}$ | $8.5 \times 10^{5}$ |
| | 1000 V | N | Y | $1.4 \times 10^{-5}$> | $1.3 \times 10^{-5}$ | $1.1 \times 10^{6}$ |
| $3.0 \times 10^{-2}$ c/kg | 250 V | (Y) | N | $2.3 \times 10^{-6}$< | $8.3 \times 10^{-6}$ | $3.5 \times 10^{5}$ |
| | 500 V | N | N | $6.3 \times 10^{-6}$< | $8.3 \times 10^{-6}$ | $6.0 \times 10^{5}$ |
| | 750 V | N | Y | $1.0 \times 10^{-5}$> | $8.3 \times 10^{-6}$ | $8.5 \times 10^{5}$ |
| | 1000 V | N | Y | $1.4 \times 10^{-5}$> | $8.3 \times 10^{-6}$ | $1.1 \times 10^{6}$ |

Vf = 2000 [kHz] Vback = 50 [V]: CONSTANT
S-D gap (d) = 500 μm

TABLE 22

| TRIBO-ELECTRIC CHARGE | Vback | POSITIVE GHOST | DENSITY CHANGE | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|---|
| $2.0 \times 10^{-2}$ c/kg | 50 V | Y | Y | $3.0 \times 10^{-5}$> | $1.3 \times 10^{-5}$ | $2.1 \times 10^{6}$ |
| | 100 V | (Y) | Y | $2.8 \times 10^{-5}$> | $1.3 \times 10^{-5}$ | $2.2 \times 10^{6}$ |
| | 150 V | N | Y | $2.7 \times 10^{-5}$> | $1.3 \times 10^{-5}$ | $2.3 \times 10^{6}$ |
| | 200 V | N | Y | $2.5 \times 10^{-5}$> | $1.3 \times 10^{-5}$ | $2.4 \times 10^{6}$ |
| $3.0 \times 10^{-2}$ c/kg | 50 V | Y | Y | $3.0 \times 10^{-5}$> | $8.3 \times 10^{-6}$ | $2.1 \times 10^{6}$ |
| | 100 V | (Y) | Y | $2.8 \times 10^{-5}$> | $8.3 \times 10^{-6}$ | $2.2 \times 10^{6}$ |
| | 150 V | N | Y | $2.7 \times 10^{-5}$> | $8.3 \times 10^{-6}$ | $2.3 \times 10^{6}$ |
| | 200 V | N | Y | $2.5 \times 10^{-5}$> | $8.3 \times 10^{-6}$ | $2.4 \times 10^{6}$ |

Vf = 2000 [kHz] Vpp = 2000 [V]: CONSTANT
S-D gap (d) = 500 μm

As for the evaluative reference, a reference Y means that the positive ghost could be visually observed; N, that the positive ghost could not be observed visually; and (Y) means that an extremely light positive ghost occurred. As for the evaluative reference for the density change in the low density area, a reference Y means that when the initial image density was 0.5, the density change was no less than 0.1 after the continuous passage of 100 sheets; and N means that it was no more than 0.1.

As is evident from the results presented in Tables 20–22, in this embodiment, the positive ghost did not occur, as it did not in Embodiment 5, even when the relationship between A and B satisfied: A<B. Also in this embodiment, the positive ghost sometimes did not occur even when A>B. However, when A>B, the density change had occurred, whereas, when the condition, A<B, was satisfied, the density change was prevented. As for the condition regarding the strength ((0.5·Vpp+Vback)/d) of the electric field applied between the photosensitive drum and developing sleeve during the toner recovery, the positive ghost could be prevented when a condition, 0.5·Vpp+Vback /d>5×10$^5$ (V/m), was satisfied. The electric field strength that satisfies this condition is less than the one required when the toner produced by the pulverizing method is used, and the reason why this electric field strength is sufficient is because the toner produced using the pulverizing method has higher separativeness.

As is evident from the above description, when the toner produced using the polymerizing method is recovered at the same time as the image is developed, the occurrences of both the positive ghost and the density change can be prevented by applying the developing bias in accordance with the following conditions to the developing sleeve.

$$\frac{(0.5)^2|0.5Vpp - Vback|}{2Vf^2} < \frac{d^2}{|Q|}$$

and $(0.5 \cdot Vpp + Vback)/d > 5 \times 10^5$ (V/m)

Embodiment 7

In Embodiments 5 and 6, evaluation was made fixing the gap between the photosensitive drum and developing sleeve at 500 μm, whereas in this embodiment, the evaluation was made setting the gap at 300 μm and 800 μm. When the gap was set at 300 μm, the electric field strengthened, and when set at 800 μm, the electric field weakened. However, the distance the toner traveled during the application of a single cycle of bias voltage changed, since the gap changed.

Also in this embodiment, the same two-component developer as the one used in Embodiment 5 was used, which was composed of the toner and magnetic carrier, wherein the toner was produced by the pulverizing method, containing the additive, titanium oxide, by 1 wt %, and the magnetic carrier had a saturation magnetization level of 205 emu/cm$^3$. The average particle diameters were 8 μm for the toner, 50 μm for the carrier, and 20 nm for the titanium oxide. (As for the mixing ratio by weight, the nonmagnetic toner occupied approximately 5%.) Also, the structure and operation of the apparatus were the same as Embodiment 5. Tables 23–26 correspond to evaluations that were made: when the alternating voltage frequency $V_f$ was varied with the gap being fixed at 300 μm; when the peak-to-peak voltage $V_{pp}$ was varied with the gap being fixed at 300 μm; the frequency $V_f$ was varied with the gap being fixed at 800 μm; and when the peak-to-peak voltage $V_{pp}$ was varied with the gap being fixed at 800 μm.

TABLE 23

| TRIBO-ELECTRIC CHARGE | Vf | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 1000 HZ | Y | $1.1 \times 10^{-4}$> | $4.5 \times 10^{-6}$ | $3.8 \times 10^{6}$ |
| | 2000 HZ | Y | $2.7 \times 10^{-5}$> | $4.5 \times 10^{-6}$ | $3.8 \times 10^{6}$ |
| | 4000 HZ | Y | $6.6 \times 10^{-6}$> | $4.5 \times 10^{-6}$ | $3.8 \times 10^{6}$ |
| | 8000 HZ | N | $1.7 \times 10^{-6}$< | $4.5 \times 10^{-6}$ | $3.8 \times 10^{6}$ |
| $3.0 \times 10^{-2}$ c/kg | 1000 HZ | Y | $1.1 \times 10^{-4}$> | $3.0 \times 10^{-6}$ | $3.8 \times 10^{6}$ |
| | 2000 HZ | Y | $2.7 \times 10^{-5}$> | $3.0 \times 10^{-6}$ | $3.8 \times 10^{6}$ |
| | 4000 HZ | Y | $6.6 \times 10^{-6}$> | $3.0 \times 10^{-6}$ | $3.8 \times 10^{6}$ |
| | 8000 HZ | N | $1.7 \times 10^{-6}$< | $3.0 \times 10^{-6}$ | $3.8 \times 10^{6}$ |

Vpp = 2000 ⌈V⌋ Vback = 150 ⌈V⌋: constant
S-D gap (d) = 300 μm

TABLE 24

| TRIBO-ELECTRIC CHARGE | Vpp | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 500 V | N | $7.8 \times 10^{-7}$< | $4.5 \times 10^{-6}$ | $1.3 \times 10^{6}$ |
| | 1000 V | N | $2.7 \times 10^{-6}$< | $4.5 \times 10^{-6}$ | $2.2 \times 10^{6}$ |
| | 1500 V | Y | $4.7 \times 10^{-6}$> | $4.5 \times 10^{-6}$ | $3.0 \times 10^{6}$ |
| | 2000 V | Y | $6.6 \times 10^{-6}$> | $4.5 \times 10^{-6}$ | $3.8 \times 10^{6}$ |
| $3.0 \times 10^{-2}$ c/kg | 500 V | N | $7.8 \times 10^{-7}$< | $3.0 \times 10^{-6}$ | $1.3 \times 10^{6}$ |
| | 1000 V | N | $2.7 \times 10^{-6}$< | $3.0 \times 10^{-6}$ | $2.2 \times 10^{6}$ |
| | 1500 V | Y | $4.7 \times 10^{-6}$> | $3.0 \times 10^{-6}$ | $3.0 \times 10^{6}$ |
| | 2000 V | Y | $6.6 \times 10^{-6}$> | $3.0 \times 10^{-6}$ | $3.8 \times 10^{6}$ |

Vf = 4000 ⌈kHZ⌋ Vback = 150 ⌈V⌋: CONSTANT
S-D gap (d) = 300 μm

TABLE 25

| TRIBO-ELECTRIC CHARGE | Vf | POSITIVE GHOST | $\frac{(0.5)^2\lvert 0.5V_{pp} - Vback\rvert}{2Vr^2}$ A | $\frac{d^2}{Q}$ B | (0.5 Vpp + Vback)/d |
|---|---|---|---|---|---|
| $2.0 \times 10^{-2}$ c/kg | 1000 HZ | Y | $1.1 \times 10^{-4}$> | $3.2 \times 10^{-5}$ | $1.4 \times 10^{6}$ |
| | 2000 HZ | N | $2.7 \times 10^{-5}$< | $3.2 \times 10^{-5}$ | $1.4 \times 10^{6}$ |
| | 4000 HZ | N | $6.6 \times 10^{-6}$< | $3.2 \times 10^{-5}$ | $1.4 \times 10^{6}$ |
| | 8000 HZ | N | $1.7 \times 10^{-6}$< | $3.2 \times 10^{-5}$ | $1.4 \times 10^{6}$ |
| $3.0 \times 10^{-2}$ | 1000 HZ | Y | $1.1 \times 10^{-4}$> | $2.1 \times 10^{-5}$ | $1.4 \times 10^{6}$ |
| | 2000 HZ | Y | $2.7 \times 10^{-5}$> | $2.1 \times 10^{-5}$ | $1.4 \times 10^{6}$ |
| | 4000 HZ | N | $6.6 \times 10^{-6}$< | $2.1 \times 10^{-5}$ | $1.4 \times 10^{6}$ |
| | 8000 HZ | N | $1.7 \times 10^{-6}$< | $2.1 \times 10^{-5}$ | $1.4 \times 10^{6}$ |

Vpp = 2000 ⌈V⌋ Vback = 150 ⌈V⌋: CONSTANT
S-D gap (d) = 800 μm

TABLE 26

| TRIBO-ELECTRIC CHARGE | Vpp | POSITIVE GHOST | $\frac{(0.5)^2\lvert 0.5\ Vpp - Vback\rvert}{2\ Vf^2}$ A | $\frac{d^2}{Q}$ B | (0.5 Vpp + Vback)/d |
|---|---|---|---|---|---|
| $2.0 \times 10^{-2}$ c/kg | 500 V | Y | $7.8 \times 10^{-7}$ < | $3.2 \times 10^{-5}$ | $5.0 \times 10^{5}$ |
| | 1000 V | Y | $2.7 \times 10^{-6}$ < | $3.2 \times 10^{-5}$ | $8.1 \times 10^{5}$ |
| | 1500 V | N | $4.7 \times 10^{-6}$ < | $3.2 \times 10^{-5}$ | $1.1 \times 10^{6}$ |
| | 2000 V | N | $6.6 \times 10^{-5}$ < | $3.2 \times 10^{-5}$ | $1.4 \times 10^{6}$ |
| $3.0 \times 10^{-2}$ c/kg | 500 V | Y | $7.8 \times 10^{-7}$ < | $2.1 \times 10^{-5}$ | $5.0 \times 10^{5}$ |
| | 1000 V | Y | $2.7 \times 10^{-6}$ < | $2.1 \times 10^{-5}$ | $8.1 \times 10^{5}$ |
| | 1500 V | N | $4.7 \times 10^{-6}$ < | $2.1 \times 10^{-5}$ | $1.1 \times 10^{6}$ |
| | 2000 V | N | $6.6 \times 10^{-6}$ < | $2.1 \times 10^{-5}$ | $1.4 \times 10^{6}$ |

Vf = 4000 [kHZ] Vback = 150 [V]: CONSTANT
S–D gap (d) = 800 μm

As for the evaluation references, a reference Y means that the positive ghost could be visually observed; N, that the positive ghost could not be observed visually; and (Y) means that an extremely light positive ghost occurred.

As is evident from the Tables 23–26, when the toner produced using the pulverizing method is used, a preferable image suffering from no positive ghost can be obtained, regardless of the gap between the photosensitive drum and developing sleeve, by means of applying to the developing sleeve a developing bias that satisfies the following conditions for recovering the toner at the same time as the image is developed.

$$\frac{(0.5)^2|0.5Vpp - Vback|}{2Vf^2} < \frac{d^2}{|Q|}$$

and $(0.5 \cdot Vpp + Vback)/d > 1 \times 10^6$ (V/m)

Embodiment 8

In Embodiments 5 and 6, evaluation was made fixing the gap between the photosensitive drum and developing sleeve at 500 μm, whereas in this embodiment, the evaluation was made setting the gap at 300 μm and 800 μm. When the gap was set at 300 μm, the electric field strengthened, and when set at 800 μm, the electric field weakened. Also in this embodiment, the same two-component developer as the one used in Embodiment 6 was used, which was composed of the toner and magnetic particle (carrier), wherein the toner was produced by the polymerizing method, containing the additive, titanium oxide, by 1 wt %, and the magnetic carrier had a saturation magnetization level of 205 emu/cm$^3$. The average particle diameters were 8 μm for the toner, 50 μm for the carrier, and 20 nm for the titanium oxide. (As for the mixing ratio by weight, the nonmagnetic toner occupied approximately 5%.) Also, the structure or operation of the apparatus was the same as Embodiment 5. Tables 27–30 correspond to evaluations of the positive ghost occurrence and the density change of the low density area, which were made: when the alternating voltage frequency $V_f$ was varied with the gap being fixed at 300 μm; when the peak-to-peak voltage $V_{pp}$ was varied with the gap being fixed at 300 μm; the frequency $V_f$ was varied with the gap being fixed at 800 μm; and when the peak-to-peak voltage $V_{pp}$ was varied with the gap being fixed at 800 μm.

TABLE 27

| TRIBO-ELECTRIC CHARGE | Vf | POSITIVE GHOST | DENSITY CHANGE | $\frac{(0.5)^2\|0.5\ Vpp - Vback\|}{2\ Vf^2}$ A | $\frac{d^2}{Q}$ B | (0.5 Vpp + Vback)/d |
|---|---|---|---|---|---|---|
| $2.0 \times 10^{-2}$ | 1000 HZ | Y | Y | $1.2 \times 10^{-4}$ > | $4.5 \times 10^{-6}$ | $3.5 \times 10^{6}$ |
| c/kg | 2000 HZ | (Y) | Y | $3.0 \times 10^{-5}$ > | $4.5 \times 10^{-6}$ | $3.5 \times 10^{6}$ |
| | 4000 HZ | N | Y | $7.4 \times 10^{-6}$ > | $4.5 \times 10^{-6}$ | $3.5 \times 10^{6}$ |
| | 8000 HZ | N | N | $1.9 \times 10^{-6}$ < | $4.5 \times 10^{-6}$ | $3.5 \times 10^{6}$ |
| $3.0 \times 10^{-2}$ | 1000 HZ | Y | Y | $1.2 \times 10^{-4}$ > | $3.0 \times 10^{-6}$ | $3.5 \times 10^{6}$ |
| c/kg | 2000 HZ | (Y) | Y | $3.0 \times 10^{-5}$ > | $3.0 \times 10^{-6}$ | $3.5 \times 10^{6}$ |
| | 4000 HZ | N | Y | $7.4 \times 10^{-6}$ > | $3.0 \times 10^{-6}$ | $3.5 \times 10^{6}$ |
| | 8000 HZ | N | N | $1.9 \times 10^{-6}$ < | $3.0 \times 10^{-6}$ | $3.6 \times 10^{6}$ |

Vpp = 2000 [V] Vback = 50 [V]: CONSTANT
S–D gap (d) = 300 μm

TABLE 28

| TRIBO-ELECTRIC CHARGE | Vpp | POSITIVE GHOST | DENSITY CHANGE | $\frac{(0.5)^2\|0.5\ Vpp - Vback\|}{2\ Vf^2}$ A | $\frac{d^2}{Q}$ B | (0.5 Vpp + Vback)/d |
|---|---|---|---|---|---|---|
| $2.0 \times 10^{-2}$ | 250 V | N | N | $2.3 \times 10^{-6}$ < | $4.5 \times 10^{-6}$ | $5.8 \times 10^{5}$ |
| c/kg | 500 V | (Y) | Y | $6.2 \times 10^{-6}$ > | $4.5 \times 10^{-6}$ | $1.0 \times 10^{6}$ |
| | 750 V | (Y) | Y | $1.0 \times 10^{-5}$ > | $4.5 \times 10^{-6}$ | $1.4 \times 10^{6}$ |
| | 1000 V | (Y) | Y | $1.4 \times 10^{-5}$ > | $4.5 \times 10^{-6}$ | $1.8 \times 10^{6}$ |
| $3.0 \times 10^{-2}$ | 250 V | N | N | $2.3 \times 10^{-6}$ < | $3.0 \times 10^{-6}$ | $5.8 \times 10^{5}$ |
| c/kg | 500 V | (Y) | Y | $6.2 \times 10^{-6}$ > | $3.0 \times 10^{-6}$ | $1.0 \times 10^{6}$ |
| | 750 V | (Y) | Y | $1.0 \times 10^{-5}$ > | $3.0 \times 10^{-6}$ | $1.4 \times 10^{6}$ |
| | 1000 V | (Y) | Y | $1.4 \times 10^{-5}$ > | $3.0 \times 10^{-6}$ | $1.8 \times 10^{6}$ |

Vf = 2000 [kHz] Vback = 50 [V]: CONSTANT
S–D gap (d) = 300 μm

TABLE 29

| TRIBO-ELECTRIC CHARGE | Vf | POSITIVE GHOST | DENSITY CHANGE | $\frac{(0.5)^2\|0.5\ Vpp - Vback\|}{2\ Vf^2}$ A | $\frac{d^2}{Q}$ B | (0.5 Vpp + Vback)/d |
|---|---|---|---|---|---|---|
| $2.0 \times 10^{-2}$ | 1000 HZ | Y | Y | $1.2 \times 10^{-4}$ > | $3.2 \times 10^{-5}$ | $1.3 \times 10^{6}$ |
| c/kg | 2000 HZ | N | N | $3.0 \times 10^{-5}$ < | $3.2 \times 10^{-5}$ | $1.3 \times 10^{6}$ |
| | 4000 HZ | N | N | $7.4 \times 10^{-6}$ < | $3.2 \times 10^{-5}$ | $1.3 \times 10^{6}$ |
| | 8000 HZ | N | N | $1.9 \times 10^{-6}$ < | $3.2 \times 10^{-5}$ | $1.3 \times 10^{6}$ |
| $3.0 \times 10^{-2}$ | 1000 HZ | Y | Y | $1.2 \times 10^{-4}$ > | $2.1 \times 10^{-5}$ | $1.3 \times 10^{6}$ |
| c/kg | 2000 HZ | N | Y | $3.0 \times 10^{-5}$ > | $2.1 \times 10^{-5}$ | $1.3 \times 10^{6}$ |

TABLE 29-continued

| TRIBO-ELECTRIC CHARGE | Vf | POSITIVE GHOST | DENSITY CHANGE | $\frac{(0.5)^2\lvert 0.5\ Vpp - Vback\rvert}{2\ Vf^2}$ A | $\frac{d^2}{Q}$ B | (0.5 Vpp + Vback)/d |
|---|---|---|---|---|---|---|
| | 4000 HZ | N | N | $7.4 \times 10^{-6}$ < | $2.1 \times 10^{-5}$ | $1.3 \times 10^{6}$ |
| | 8000 HZ | N | N | $1.9 \times 10^{-6}$ < | $2.1 \times 10^{-5}$ | $1.3 \times 10^{6}$ |

Vpp = 2000 [V] Vback = 5 [V]: CONSTANT
S–D gap (d) = 800 $\mu$m

TABLE 30

| TRIBO-ELECTRIC CHARGE | Vpp | POSITIVE GHOST | DENSITY CHANGE | $\frac{(0.5)^2\lvert 0.5\ Vpp - Vback\rvert}{2\ Vf^2}$ A | $\frac{d^2}{Q}$ B | (0.5 Vpp + Vback)/d |
|---|---|---|---|---|---|---|
| $2.0 \times 10^{-2}$ | 250 V | Y | N | $2.3 \times 10^{-6}$ < | $3.2 \times 10^{-5}$ | $2.2 \times 10^{5}$ |
| c/kg | 500 V | (Y) | N | $6.2 \times 10^{-6}$ < | $3.2 \times 10^{-5}$ | $3.7 \times 10^{5}$ |
| | 750 V | N | N | $1.0 \times 10^{-5}$ < | $3.2 \times 10^{-5}$ | $5.3 \times 10^{5}$ |
| | 1000 V | N | N | $1.4 \times 10^{-5}$ < | $3.2 \times 10^{-5}$ | $6.9 \times 10^{5}$ |
| $3.0 \times 10^{-2}$ | 250 V | Y | N | $2.3 \times 10^{-6}$ < | $2.1 \times 10^{-3}$ | $2.2 \times 10^{5}$ |
| c/kg | 500 V | (Y) | N | $6.2 \times 10^{-6}$ < | $2.1 \times 10^{-5}$ | $3.7 \times 10^{5}$ |
| | 750 V | N | N | $1.0 \times 10^{-5}$ < | $2.1 \times 10^{-5}$ | $5.3 \times 10^{5}$ |
| | 1000 V | N | N | $1.4 \times 10^{-5}$ < | $2.1 \times 10^{-5}$ | $6.9 \times 10^{5}$ |

Vf = 2000 [kHz] Vback = 50 [V]: CONSTANT
S–D gap (d) = 800 $\mu$m

As for the evaluative references, a reference Y means that the positive ghost could be visually observed; N, that the positive ghost could not be observed visually; and (Y) means that an extremely light positive ghost occurred. As for the evaluative references for the density change in the low density area, a reference Y means that when the initial image density was 0.5, the density change was no less than 0.1 after the continuous passage of 100 sheets; and N means that it was no more than 0.1.

As is evident from the Tables 27–30, when the toner produced using the polymerizing method is used, a preferable image suffering from no positive ghost and/or density change of the low density area can be obtained, regardless of the gap between the photosensitive drum and developing sleeve, by means of applying to the developing sleeve a developing bias that satisfies the following conditions for recovering the toner at the same time as the image is developed.

$$\frac{(0.5)^2\lvert 0.5Vpp - Vback\rvert}{2Vf^2} < \frac{d^2}{\lvert Q\rvert}$$

and $(0.5 \cdot Vpp + Vback)/d > 5.0 \times 10^5$ (V/m)

Embodiment 9

In Embodiments 5–8, studies were made with regard to a rectangular wave-form having the same configuration on the transfer and recovery sides as shown in FIG. 10(1), whereas the wave-form configuration of the alternating voltage applied in this embodiment was such that the transfer and recovery sides were equal in integrated area size, but were different in the ratio of application time.

As for an example of the application ratio of such an alternating voltage, when the duration ratios are set at 0.3 and 0.7 for the transfer and recovery sides, respectively, with a single full cycle (1/Vf) being 1, the alternating voltage components are set at 0.7 $V_{pp}$ and 0.3 $V_{pp}$ for the transfer and recovery sides, respectively.

When the temporal ratio for the length of time the transfer side of the alternating voltage is applied is designated by S, the length of time the transfer and recovery sides of the alternating voltage are applied to the residual toner on the electrostatic latent image portion in the white background area are S/Vf second and (1–S)/Vf second, respectively. The distance X the toner can travel during these period are expressed by the following formulas:

$$X = \frac{1}{2}\ a\left(\frac{S}{Vf}\right)^2 = \frac{1}{2}\left(\frac{\lvert q\rvert}{m}\ \frac{\Delta V}{d}\right)\frac{(S)^2}{Vf^2} = \frac{(S)^2\lvert Q\rvert}{2d}\ \frac{\Delta V}{Vf^2}$$

Transfer side (developing sleeve photosensitive drum direction)

$$X_+ = \frac{(S)^2\lvert Q\rvert}{2d}\ \frac{\lvert(1-S)Vpp - Vback\rvert}{Vf^2}$$

Recovery side (photosensitive drum developing sleeve)

$$X_- = \frac{(1-S)^2\lvert Q\rvert}{2d}\ \frac{\lvert S \cdot Vpp + Vback\rvert}{Vf^2}$$

When conditions are established such that a distance X+, which the residual toner having been stripped from the photosensitive drum as described in Embodiments 1 and 2 travels when the transfer side voltage is applied by a single cycle equivalent, that is, for a duration of (S/Vf), is not long enough for the toner to reach the photosensitive drum, the toner collects on the developing sleeve side, continually oscillating thereon (this is because the fog removing voltage $V_{back}$ is set so as to satisfy the inequity, X+<X–). Such conditions are expressed by the following formula, under which X+is smaller than the gap d between the photosensitive drum and developing sleeve.

$$X_+ = \frac{S^2\lvert Q\rvert}{2d}\ \frac{\lvert(1-S)\cdot Vpp + Vback\rvert}{Vf^2} < d$$

-continued $$\frac{(S)^2}{2}\ \frac{|(1-S)Vpp-Vback|}{Vf^2} < \frac{d^2}{|Q|}$$

Under such conditions, the distance X−, which the toner having transferred onto the image portion on the photosensitive drum as in Embodiments 1 and 2 travels when a single cycle equivalent of the stripping voltage is applied, is not far enough for the toner to return to the developing sleeve; therefore, the toner collects on the photosensitive drum side, continually oscillating thereon (this is because the contrast potential $V_{cont}$ is established to satisfy the inequity X+>X−.)

As a result, the toner jumps in such a manner as to concentrate onto the electrostatic latent image on the photosensitive drum, improving thereby the image quality.

Also, in this embodiment, the two-component developer composed of the toner and magnetic particle (carrier) was used, wherein the toner was produced using the pulverizing method, containing titanium oxide as the additive, by 1 wt %, and the carrier had a saturation magnetization level of 205 emu/cm$^3$. The average particle diameters were 8 $\mu$m for the toner, 50 $\mu$m for the carrier, and 20 nm for the titanium oxide. (The mixing ratio was set so that the nonmagnetic toner occupied approximately 5 wt %.) Also, the structure or operation of the apparatus was the same as the one in Embodiment 5. The following tables show the results obtained by varying the frequency Vf of the alternating voltage, wherein Tables 31–33 correspond to cases in which the gap between the photosensitive drum and developing sleeve was set at 500 $\mu$m, 300 $\mu$m and 800 $\mu$m.

TABLE 31

| | Vf | POSITIVE GHOST | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|
| TRANSFER | 1000 HZ | Y | $6.1\times10^{-5}$ > | $8.3\times10^{-6}$ | $1.3\times10^{6}$ |
| S = 0.3 | 2000 HZ | Y | $1.5\times10^{-5}$ > | $8.3\times10^{-6}$ | $1.3\times10^{6}$ |
| BACK TRANSFER | 4000 HZ | N | $3.8\times10^{-6}$ < | $8.3\times10^{-6}$ | $1.3\times10^{6}$ |
| 1 − S = 0.7 | 8000 HZ | N | $9.5\times10^{-7}$ < | $8.3\times10^{-6}$ | $1.3\times10^{6}$ |
| Vback = 50 [V] | | | | | |
| Vpp = 2000 [V] | | | | | |
| TRANSFER | 1000 HZ | Y | $3.6\times10^{-5}$ > | $8.3\times10^{-6}$ | $1.7\times10^{6}$ |
| S = 0.7 | 2000 HZ | Y | $9.2\times10^{-6}$ > | $8.3\times10^{-6}$ | $1.7\times10^{6}$ |
| BACK TRANSFER | 4000 HZ | N | $2.3\times10^{-6}$ < | $8.3\times10^{-6}$ | $1.7\times10^{6}$ |
| 1 − S = 0.3 | 8000 HZ | N | $5.7\times10^{-7}$ < | $8.3\times10^{-6}$ | $1.7\times10^{6}$ |
| Vback = 150 [V] | | | | | |
| Vpp = 1000 [V] | | | | | |

TRIBOELECTRIC CHARGE 3.0 ($10^{-2}$ c/kg): CONSTANT
S–D gap (d) = 500 $\mu$m

TABLE 32

| | Vf | POSITIVE GHOST | $\frac{(S)^2\lvert(1-S)Vpp-Vback\rvert}{2\cdot Vf^2}$ A | $\frac{d^2}{Q}$ B | (S · Vpp + Vback)/d |
|---|---|---|---|---|---|
| TRANSFER | 1000 HZ | Y | $6.1\times10^{-5}$ > | $3.0\times10^{-6}$ | $2.2\times10^{6}$ |
| S = 0.3 | 2000 HZ | Y | $1.5\times10^{-5}$ > | $3.0\times10^{-6}$ | $2.2\times10^{6}$ |
| BACK TRANSFER | 4000 HZ | Y | $3.8\times10^{-6}$ > | $3.0\times10^{-6}$ | $2.2\times10^{6}$ |
| 1 − S = 0.7 | 8000 HZ | N | $9.5\times10^{-7}$ < | $3.0\times10^{-6}$ | $2.2\times10^{6}$ |
| Vback = 50 [V] | | | | | |
| Vpp = 2000 [V] | | | | | |
| TRANSFER | 1000 HZ | Y | $3.6\times10^{-5}$ > | $3.0\times10^{-6}$ | $2.8\times10^{6}$ |
| S = 0.7 | 2000 HZ | Y | $9.2\times10^{-6}$ > | $3.0\times10^{-6}$ | $2.8\times10^{6}$ |
| BACK TRANSFER | 4000 HZ | N | $2.3\times10^{-6}$ < | $3.0\times10^{-6}$ | $2.8\times10^{6}$ |
| 1 − S = 0.3 | 8000 HZ | N | $5.7\times10^{-7}$ < | $3.0\times10^{-6}$ | $2.8\times10^{6}$ |
| Vback = 150 [V] | | | | | |
| Vpp = 1000 [V] | | | | | |

TRIBOELECTRIC CHARGE 3.0 ($10^{-2}$ c/kg): CONSTANT
S–D gap (d) = 500 $\mu$m

TABLE 33

| | Vf | POSITIVE GHOST | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|
| TRANSFER | 1000 HZ | Y | $6.1\times10^{-5}$ > | $2.1\times10^{-5}$ | $9.4\times10^{5}$ |
| S = 0.3 | 2000 HZ | Y | $1.5\times10^{-5}$ < | $2.1\times10^{-5}$ | $9.4\times10^{5}$ |
| BACK TRANSFER | 4000 HZ | (Y) | $3.8\times10^{-6}$ < | $2.1\times10^{-5}$ | $9.4\times10^{5}$ |
| 1 − S = 0.7 | 8000 HZ | (Y) | $9.5\times10^{-7}$ < | $2.1\times10^{-5}$ | $9.4\times10^{5}$ |
| Vback = 50 [V] | | | | | |

TABLE 33-continued

| | Vf | POSITIVE GHOST | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|
| Vpp = 2000 [V] | | | | | |
| TRANSFER | 1000 HZ | Y | $4.9 \times 10^{-5}$ > | $2.1 \times 10^{-5}$ | $1.6 \times 10^{6}$ |
| S = 0.7 | 2000 HZ | N | $1.2 \times 10^{-5}$ < | $2.1 \times 10^{-5}$ | $1.6 \times 10^{6}$ |
| BACK TRANSFER | 4000 HZ | N | $3.1 \times 10^{-6}$ < | $2.1 \times 10^{-5}$ | $1.6 \times 10^{6}$ |
| 1 − S = 0.3 | 8000 HZ | N | $7.7 \times 10^{-7}$ < | $2.1 \times 10^{-5}$ | $1.6 \times 10^{6}$ |
| Vback = 250 [V] | | | | | |
| Vpp = 1500 [V] | | | | | |

TRIBOELECTRIC CHARGE 3.0 ($10^{-2}$ c/kg): CONSTANT
S–D gap (d) = 500 $\mu$m

As for the evaluative references, a reference Y means that the positive ghost could be visually observed; N, that the positive ghost could not be observed visually; and (Y) means that an extremely light positive ghost occurred.

As is evident from Tables 31–33, even when an alternating voltage having such a wave-form configuration that the transfer and return sides are different in terms of the temporal ratio, but are the same in terms of the integral area size, is applied as it was in this embodiment, a preferable image suffering from no positive image can be obtained by applying, in order to develop an image, a developing bias in accordance with the following conditions, under which the residual toner is stripped from the photosensitive drum and does not return thereto when a single cycle equivalent of the transfer side alternating voltage is applied.

$$\frac{S^2|(1-S)Vpp-Vback|}{2Vf^2} < \frac{d^2}{|Q|}$$

and $(S \cdot Vpp + Vback)/d > 1 \times 10^8$ (V/m)

Embodiment 10

In Embodiments 5–8, studies were made using an alternating voltage, the wave-form configuration of which was such that the transfer and return sides are the same as shown in FIG. 10(1), but in this embodiment, an alternating voltage such as the one used in Embodiment 9 was used, the wave-form configuration of which was such that the transfer and return sides were the same in terms of the integrated area size, but were different in terms of the temporal ratio.

Also in this embodiment, two-component developer was obtained by mixing spherical toner and magnetic particle (carrier) as it was in Embodiments and 6 and 8, wherein the toner was produced using the polymerizing method, containing the additive, titanium oxide, by 1 wt %, and the carrier had a saturation magnetization level of 205 emu/cm$^3$. The average particle diameters were 20 nm for the additive, and 50 $\mu$m for the carrier. (As for the mixing ratio, the nonmagnetic toner occupied approximately 5 wt %.). The structure and operation of the apparatus were the same as Embodiment 5.

The following tables show the evaluations of the positive ghost and density change in the low density area, which occurred when the alternating voltage Vf was varied, wherein Tables 34–36 correspond to the cases in which the gap between the photosensitive drum and developing sleeve was 500 $\mu$m, 300 $\mu$m and 800 $\mu$m.

TABLE 34

| | Vf | POSITIVE GHOST | DENSITY CHANGE | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|---|
| TRANSFER | 1000 HZ | Y | Y | $6.1 \times 10^{-5}$ > | $8.3 \times 10^{-6}$ | $1.3 \times 10^{6}$ |
| S = 0.3 | 2000 HZ | N | Y | $1.5 \times 10^{-5}$ > | $8.3 \times 10^{-6}$ | $1.3 \times 10^{6}$ |
| BACK TRANSFER | 4000 HZ | N | N | $3.8 \times 10^{-6}$ < | $8.3 \times 10^{-6}$ | $1.3 \times 10^{6}$ |
| 1 − S = 0.7 | 8000 HZ | N | N | $9.5 \times 10^{-7}$ < | $8.3 \times 10^{-6}$ | $1.3 \times 10^{6}$ |
| Vback = 50 [V] | | | | | | |
| Vpp = 2000 [V] | | | | | | |
| TRANSFER | 1000 HZ | Y | Y | $3.6 \times 10^{-5}$ > | $8.3 \times 10^{-6}$ | $1.7 \times 10^{6}$ |
| S = 0.7 | 2000 HZ | N | Y | $9.2 \times 10^{-6}$ > | $8.3 \times 10^{-6}$ | $1.7 \times 10^{6}$ |
| BACK TRANSFER | 4000 HZ | N | N | $2.3 \times 10^{-6}$ < | $8.3 \times 10^{-6}$ | $1.7 \times 10^{6}$ |
| 1 − S = 0.3 | 8000 HZ | N | N | $5.7 \times 10^{-7}$ < | $8.3 \times 10^{-6}$ | $1.7 \times 10^{6}$ |
| Vback = 150 [V] | | | | | | |
| Vpp = 1000 [V] | | | | | | |

TRIBOELECTRIC CHARGE 3.0 ($10^{-2}$ c/kg): CONSTANT
S–D gap (d) = 500 $\mu$m

TABLE 35

| | Vf | POSITIVE GHOST | DENSITY CHANGE | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|---|
| TRANSFER | 1000 HZ | Y | Y | $6.1 \times 10^{-5}$ > | $3.0 \times 10^{-6}$ | $2.2 \times 10^{6}$ |
| S = 0.3 | 2000 HZ | (Y) | Y | $1.5 \times 10^{-5}$ > | $3.0 \times 10^{-6}$ | $2.2 \times 10^{6}$ |
| BACK TRANSFER | 4000 HZ | N | Y | $3.8 \times 10^{-6}$ > | $3.0 \times 10^{-6}$ | $2.2 \times 10^{6}$ |
| 1 − S = 0.7 | 8000 HZ | N | N | $9.5 \times 10^{-7}$ < | $3.0 \times 10^{-6}$ | $2.2 \times 10^{6}$ |
| Vback = 50 [V] | | | | | | |
| Vpp = 2000 [V] | | | | | | |
| TRANSFER | 1000 HZ | Y | Y | $3.6 \times 10^{-5}$ > | $3.0 \times 10^{-6}$ | $2.8 \times 10^{6}$ |
| S = 0.7 | 2000 HZ | N | Y | $9.2 \times 10^{-6}$ > | $3.0 \times 10^{-6}$ | $2.8 \times 10^{6}$ |
| BACK TRANSFER | 4000 HZ | N | N | $2.3 \times 10^{-6}$ < | $3.0 \times 10^{-6}$ | $2.8 \times 10^{6}$ |
| 1 − S = 0.3 | 8000 HZ | N | N | $5.7 \times 10^{-7}$ < | $3.0 \times 10^{-6}$ | $2.8 \times 10^{6}$ |
| Vback = 150 [V] | | | | | | |
| Vpp = 1000 [V] | | | | | | |

TRIBOELECTRIC CHARGE 3.0 ($10^{-2}$ c/kg): CONSTANT
S–D gap (d) = 500 $\mu$m

TABLE 36

| | Vf | POSITIVE GHOST | DENSITY CHANGE | $\frac{(S)^2\lvert(1-S)Vpp-Vback\rvert}{2\,Vf^2}$ A | $\frac{d^2}{Q}$ B | (S · Vpp + Vback)/d |
|---|---|---|---|---|---|---|
| TRANSFER | 1000 HZ | Y | Y | $6.1 \times 10^{-5}$ > | $2.1 \times 10^{-5}$ | $9.4 \times 10^{5}$ |
| S = 0.3 | 2000 HZ | N | N | $1.5 \times 10^{-5}$ < | $2.1 \times 10^{-5}$ | $9.4 \times 10^{5}$ |
| BACK TRANSFER | 4000 HZ | N | N | $3.8 \times 10^{-6}$ < | $2.1 \times 10^{-5}$ | $9.4 \times 10^{5}$ |
| 1 − S = 0.7 | 8000 HZ | N | N | $9.5 \times 10^{-7}$ < | $2.1 \times 10^{-5}$ | $9.4 \times 10^{5}$ |
| Vback = 50 [V] | | | | | | |
| Vpp = 2000 [V] | | | | | | |
| TRANSFER | 1000 HZ | Y | Y | $4.9 \times 10^{-5}$ > | $2.1 \times 10^{-5}$ | $1.6 \times 10^{6}$ |
| S = 0.7 | 2000 HZ | N | N | $1.2 \times 10^{-5}$ < | $2.1 \times 10^{-5}$ | $1.6 \times 10^{6}$ |
| BACK TRANSFER | 4000 HZ | N | N | $3.1 \times 10^{-6}$ < | $2.1 \times 10^{-5}$ | $1.6 \times 10^{6}$ |
| 1 − S = 0.3 | 8000 HZ | N | N | $7.7 \times 10^{-7}$ < | $2.1 \times 10^{-5}$ | $1.6 \times 10^{6}$ |
| Vback = 250 [V] | | | | | | |
| Vpp = 1500 [V] | | | | | | |

TRIBOELECTRIC CHARGE 3.0 ($10^{-2}$ c/kg): CONSTANT
S–D gap (d) = 500 $\mu$m

As for the evaluative references, a reference Y means that the positive ghost could be visually observed; N, that the positive ghost could not be observed visually; and (Y) means that an extremely light positive ghost occurred. As for the evaluative references for the density change in the low density area, a reference Y means that when the initial image density was 0.5, the density change was no less than 0.1 after the continuous passage of 100 sheets; and N means that it was no more than 0.1.

As is evident from Tables 34–36, even when an alternating voltage having such a wave-form configuration that the transfer and return sides are different in terms of the temporal ratio, but are the same in terms of the integrated area size, is applied as it was in this embodiment, a preferable image suffering from no positive image can be obtained by establishing an image developing bias in accordance with the following conditions, under which the residual toner is stripped from the photosensitive drum and does not return thereto when a single cycle equivalent of the transfer side alternating voltage is applied.

$$\frac{S^2|(1-S)Vpp-Vback|}{2Vf^2} < \frac{d^2}{|Q|}$$

and $(S \cdot Vpp + Vback)/d > 5.0 \times 10^5$ (V/m)

Embodiment 11

In Embodiments 5–10, studies were made using the conditions under which an alternating voltage was applied with no interruption as shown in FIGS. 10(1) and 10(2). In this embodiment, however, studies were made using such wave-form configurations that there was an interruption after a consecutive application of a transfer side voltage and a return side voltage, as illustrated in FIGS. 10(3)–10(5): FIG. 10(3) illustrates a case in which an interruption follows the application of the transfer side voltage; FIG. 10(4), a case in which an interruption follows the application of the return side voltage; and FIG. 10(5) illustrates a case in which an interruption follows both the applications of transfer and return side voltages.

When the durations of the alternating voltage interruption after the applications of the transfer and return side voltages were $\alpha$ ($\alpha$/Vf sec) and $\beta$ ($\beta$/Vf sec), respectively, a combination of an AC and a DC voltages was applied to the transfer and return sides for a duration of $(S+\alpha)$/Vf second, and $(1-S+\beta)$Vf second, respectively. Generally, it is considered that the frequency Vf involves the duration of the interruptions but in the present invention, the duration, 1/Vf, of the alternating voltage application was defined as the duration of active portion of the alternating voltage excluding the interruption.

The distance X the toner can travel for a duration of a single cycle of alternating voltage can be expressed by the following formulas, provided that the toner jumps at a constant speed during the interrupted portion of the alternating voltage (when only the DC voltage is applied).

$$X = \frac{1}{2}\, a\left(\frac{S}{Vf}\right)^2 + a\left(\frac{S}{Vf}\right)\left(\frac{\alpha}{Vf}\right) =$$

$$\left(\frac{|q|}{m}\ \frac{\Delta V}{d}\right)\frac{S\cdot\left(\frac{1}{2}\,S+\alpha\right)}{Vf^2} = \frac{S\cdot\left(\frac{1}{2}\,S+\alpha\right)|Q|}{d}\ \frac{\Delta V}{Vf^2}$$

Transfer side (developing sleeve photosensitive drum direction)

$$X_+ = \frac{S(S+2\alpha)|Q|}{2d}\ \frac{|(1-S)Vpp - Vback|}{Vf^2}$$

Return side (photosensitive drum developing sleeve direction)

$$X_- = \frac{(1-S)(1-S+2\beta)|Q|}{2d}\ \frac{|S\cdot Vpp + Vback|}{Vf^2}$$

When conditions are established such that a distance X+, which the residual toner having been stripped from the photosensitive drum as described in Embodiments 1 and 2 travels when the transfer side voltage is applied for a duration of a single cycle equivalent, ((S+a)/Vf), is not long enough for the toner to reach the photosensitive drum, the toner collects on the developing sleeve side, continually oscillating thereon (this is because the fog removing voltage $V_{back}$ is set so as to satisfy the inequity, X+<X−).

Such conditions are expressed by the following formula, under which X+ is smaller than the gap d between the photosensitive drum and developing sleeve.

$$\frac{S(S+2\alpha)|Q|}{2d}\ \frac{|(1-S)Vpp - Vback|}{Vf^2} < d$$

$$\frac{S(S+2\alpha)}{2}\ \frac{|(1-S)Vpp - Vback|}{Vf^2} < \frac{d^2}{|Q|}$$

Under such conditions, the distance X−, which the toner having been transferred onto the image portion on the photosensitive drum as in Embodiments 5, 6, 9 and 10 travels when the stripping voltage is applied by a single cycle equivalent of the alternating voltage, that is, for a duration of ((1−S+β) second, is not far enough for the toner to return to the developing sleeve; therefore, the toner collects on the photosensitive drum, continually oscillating thereon (this is because the contrast potential Vcont is established to satisfy the inequity X+>X−.)

As a result, the toner jumps in such a manner as to concentrate onto the electrostatic latent image on the photosensitive drum, improving thereby the image quality.

Also, in this embodiment, the two-component developer composed of the toner and magnetic particle (carrier) was used, wherein the toner was produced by the pulverizing method, containing titanium oxide as the additive, by 1 wt %, and the carrier had a saturation magnetization level of 205 emu/cm$^3$. The average particle diameters were 8 $\mu$m for the toner, 50 $\mu$m for the carrier, and 20 nm for the titanium oxide. (The mixing radio was set so that the nonmagnetic toner occupied approximately 5 wt %.) Also, the structure or process of the apparatus was the same as the one in Embodiment 5. Tables 37 presents the evaluation of the positive ghost occurrence with reference to differences in the alternating voltage frequency $V_f$, and duration of the interruption, wherein three cases are given, in which the application of the transfer side voltage was followed by an interruption equivalent to 0.25 cycle (α=0.25) as illustrated in FIG. 10(3); the application of the return side voltage was followed by an interruption equivalent to 0.25 cycle (β=0.25) as illustrated in FIG. 10(4); and both the applications of the transfer and return side voltages were followed by an interruption equivalent to 0.25 cycle (α=0.25 and β=0.25) as illustrated in FIG. 10(5).

TABLE 37

| | Vf * | POSITIVE GHOST | DENSITY CHANGE | $\frac{S(S+2r)\lvert(1-S)Vpp-Vback\rvert}{2\,Vf^2}$ A | $\frac{d^2}{Q}$ B | (S · Vpp + Vback)/d |
|---|---|---|---|---|---|---|
| REST AFTER TRANSFER | 1000 HZ | Y | Y | $7.5 \times 10^{-5}$ > | $8.3 \times 10^{-6}$ | $1.4 \times 10^{6}$ |
| α = 0.25 | 2000 HZ | (Y) | Y | $1.9 \times 10^{-5}$ > | $8.3 \times 10^{-6}$ | $1.4 \times 10^{6}$ |
| REST AFTER BACK TRANS. | 4000 HZ | N | N | $4.7 \times 10^{-6}$ < | $8.3 \times 10^{-6}$ | $1.4 \times 10^{6}$ |
| β = 0 | 8000 HZ | N | N | $1.2 \times 10^{-6}$ < | $8.3 \times 10^{-6}$ | $1.4 \times 10^{6}$ |
| Vback = 200 [V] | | | | | | |
| Vpp = 1000 [V] | | | | | | |
| REST AFTER TRANSFER | 1000 HZ | (Y) | Y | $1.2 \times 10^{-4}$ > | $8.3 \times 10^{-6}$ | $2.1 \times 10^{6}$ |
| α = 0 | 2000 HZ | N | Y | $3.0 \times 10^{-5}$ > | $8.3 \times 10^{-6}$ | $2.1 \times 10^{6}$ |
| REST AFTER BACK TRANS. | 4000 HZ | N | N | $7.4 \times 10^{-6}$ < | $8.3 \times 10^{-6}$ | $2.1 \times 10^{6}$ |
| β = 0.25 | 8000 HZ | N | N | $1.9 \times 10^{-6}$ < | $8.3 \times 10^{-6}$ | $2.1 \times 10^{6}$ |
| Vback = 50 [V] | | | | | | |
| Vpp = 2000 [V] | | | | | | |
| REST AFTER TRANSFER | 1000 HZ | (Y) | Y | $2.1 \times 10^{-4}$ > | $8.3 \times 10^{-6}$ | $2.3 \times 10^{6}$ |
| α = 0.25 | 2000 HZ | (Y) | Y | $5.3 \times 10^{-5}$ > | $8.3 \times 10^{-6}$ | $2.3 \times 10^{6}$ |
| REST AFTER BACK TRANS. | 4000 HZ | N | Y | $1.3 \times 10^{-5}$ > | $8.3 \times 10^{-6}$ | $2.3 \times 10^{6}$ |
| β = 0.25 | 8000 HZ | N | N | $3.3 \times 10^{-6}$ < | $8.3 \times 10^{-6}$ | $2.3 \times 10^{6}$ |
| Vback = 150 [V] | | | | | | |
| Vpp = 2000 [V] | | | | | | |

TRIBOELECTRIC CHARGE 3.0 ($10^{-2}$ c/kg): CONSTANT
S–D gap (d) = 500 $\mu$m
*: excluding rest period.

As for the evaluative references, a reference Y means that the positive ghost could be visually observed; N, that the positive ghost could not be observed visually; and (Y) means that an extremely light positive ghost occurred.

As is evident from Tables 37, even when an alternating voltage having such a wave-form configuration that both the transfer side voltage and return side voltage are followed by an interruption of the alternating voltage as they were in this embodiment, a preferable image suffering from no positive image can be obtained by establishing an image developing bias in accordance with the following conditions, under which the residual toner is stripped from the photosensitive drum and does not return thereto, as in Embodiments 5, 7 and 9, when the transfer side voltage is applied for a duration of a single cycle equivalent (for a duration of (S+α)/Vf second).

and 20 nm for the additive. (The mixing ratio was established so as for the magnetic toner to occupy approximately 5 wt %.) The structure and operation of the apparatus were also the same as Embodiment 5.

Table 38 presents the evaluation of the positive ghost and the density change in the low density area which occurred in this embodiment, with reference to differences in the alternating voltage frequency $V_f$, and the type of the interruption, wherein three cases are given as was in Embodiment 11, in which the application of the transfer side voltage was followed by an interruption equivalent to 0.25 cycle (α=0.25) as illustrated in FIG. 10(3); the application of the return side voltage was followed by an interruption equivalent to 0.25 cycle (β=0.25) as illustrated in FIG. 10(4); and both the applications of the transfer and return side voltages were followed by an interruption equivalent to 0.25 cycle (α=0.25 and β=0.25) as illustrated is FIG. 10(5).

TABLE 38

| | Vf* | POSITIVE GHOST | $\frac{S(S+2e)\lvert(1-S)V_{pp}-Vback\rvert}{2Vf^2}$ A | $\frac{d^2}{Q}$ B | (S · Vpp + Vback)/d |
|---|---|---|---|---|---|
| REST AFTER | 1000 HZ | Y | $7.5 \times 10^{-5}$> | $8.3 \times 10^{-6}$ | $1.4 \times 10^{6}$ |
| TRANSFER | 2000 HZ | Y | $1.9 \times 10^{-5}$> | $8.3 \times 10^{-6}$ | $1.4 \times 10^{6}$ |
| α = 0.25 | 4000 HZ | N | $4.7 \times 10^{-6}$< | $8.3 \times 10^{-6}$ | $1.4 \times 10^{6}$ |
| REST AFTER | 8000 HZ | N | $1.2 \times 10^{-6}$< | $8.3 \times 10^{-6}$ | $1.4 \times 10^{6}$ |
| BACK TRANS | | | | | |
| β = 0 | | | | | |
| Vback = 200 [V] | | | | | |
| Vpp = 1000 [V] | | | | | |
| REST AFTER | 1000 HZ | Y | $1.2 \times 10^{-4}$> | $8.3 \times 10^{-6}$ | $2.1 \times 10^{6}$ |
| TRANSFER | 2000 HZ | Y | $3.0 \times 10^{-6}$> | $8.3 \times 10^{-6}$ | $2.1 \times 10^{6}$ |
| α = 0 | 4000 HZ | N | $7.4 \times 10^{-6}$< | $8.3 \times 10^{-6}$ | $2.1 \times 10^{6}$ |
| REST AFTER | 8000 HZ | N | $1.9 \times 10^{-6}$< | $8.3 \times 10^{-6}$ | $2.1 \times 10^{6}$ |
| BACK TRANS | | | | | |
| β = 0.25 | | | | | |
| Vback = 50 [V] | | | | | |
| Vpp = 2000 [V] | | | | | |
| REST AFTER | 1000 HZ | Y | $2.1 \times 10^{-4}$> | $8.3 \times 10^{-6}$ | $2.3 \times 10^{6}$ |
| TRANSFER | 2000 HZ | Y | $5.3 \times 10^{-5}$> | $8.3 \times 10^{-6}$ | $2.3 \times 10^{6}$ |
| α = 0.25 | 4000 HZ | Y | $1.3 \times 10^{-5}$> | $8.3 \times 10^{-6}$ | $2.3 \times 10^{6}$ |
| REST AFTER | 8000 HZ | N | $3.3 \times 10^{-6}$< | $8.3 \times 10^{-6}$ | $2.3 \times 10^{6}$ |
| BACK TRANS | | | | | |
| β = 0.25 | | | | | |
| Vback = 150 [V] | | | | | |
| Vpp = 2000 [V] | | | | | |

TRIBOELECTRIC CHARGE 3.0 ($10^{-2}$ c/kg): CONSTANT
S-D gap (d) = 500 μm
*Excluding rest period.

$$\frac{S(S+2\alpha)|(1-S)Vpp-Vback|}{2Vf^2} < \frac{d^2}{|Q|}$$

and $(S \cdot Vpp + Vback)/d > 1 \times 10^5$ (V/m)

Embodiment 12

In Embodiments 5–10, studies were made using the alternating voltage conditions as illustrated in FIGS. 10(1) and 10(2), under which an alternating voltage were applied with no interruption, whereas in this embodiment, studies were made using the wave-forms as illustrated in FIGS. 10(3)–10(5) as they were in Embodiment 11.

Also, in this embodiment, two-component developer was obtained by mixing spherical toner and magnetic particle (carrier), as it was in Embodiments 6, 8 and 10, wherein the toner was produced using the polymerizing method, containing the additive of titanium oxide by 1 wt %, and the saturation magnetization of the carrier was 205 emu/cm$^3$. The average particle diameters were 50 μm for the carrier As for the evaluative references, a reference Y means that the positive ghost could be visually observed; N, that the positive ghost could not be observed visually; and (Y) means that an extremely light positive ghost occurred. As for the evaluative references for the density change in the low density area, a reference Y means that when the initial image density was 0.5, the density change was no less than 0.1 after the continuous passage of 100 sheets; and N means that it was no more than 0.1.

As is evident from Table 38, even when an alternating voltage having such a wave-form that an interruption follows both the applications of the transfer and return voltages, as it did in this embodiment, is used, a preferable image suffering from no positive ghost and no density change can be obtained by establishing the developing bias in accordance with the following conditions, under which when the transfer side of an alternating voltage composed of a combination of an AC voltage and a DC voltage is applied to the developing sleeve for a duration of a single cycle equivalent (for a duration of $(S+\alpha)/V_f$ second), the residual toner is stripped from the photosensitive drum.

$$\frac{S(S+2\alpha)|(1-S)Vpp-Vback|}{2Vf^2} < \frac{d^2}{|Q|}$$

and $(S \cdot Vpp + Vback)/d > 5.0 \times 10^5$ (V/m)

While the invention has been described with reference to the structures disclosed herein, it is not confined to the details set forth, this application is intended to cover such modifications or changes as may come within the purposes of the improvements or the scope of the following claims.

What is claimed is:

1. An image forming apparatus comprising:

an electrostatic image bearing member for bearing an electrostatic image developed by toner;

transfer means for transferring a toner image from said image bearing member onto a transfer material;

electrostatic image forming means for forming an electrostatic image on said electrostatic image bearing member from which residual toner after image transfer operation of transfer means is not removed;

developing and cleaning means for developing the electrostatic image with toner and collecting residual toner from said image bearing member after image transfer, wherein said developing and cleaning means including a developer carrying member, faced to said image bearing member, for carrying developer containing toner, and voltage applying means for applying to said developer carrying member an oscillating voltage of a predetermined frequency;

wherein said voltage satisfies:

$$\frac{|1Vpp-2V\text{back}|}{16\,Vf^2} < \frac{d^2}{|Q|} \text{ and } Vpp/d > 2 \times 10^6\ (V/m)$$

and wherein:

Vpp [V]: a peak-to-peak voltage of the oscillating voltage

Vf [Hz]: a frequency of the oscillating voltage

Vback [V]: a potential difference between a surface potential of said electrostatic image bearing member and DC component of the oscillating voltage Q [c/kg]: an average amount of toner charge d [m]: a shortest distance between said electrostatic image bearing member and said developer carrying member.

2. An image forming apparatus according to claim 1, wherein said toner is nonmagnetic.

3. An image forming apparatus according to claim 1, wherein said developer contains a carrier, and said developer carrying member comprises a magnetic field generating member disposed therein to generate a magnetic field.

4. An image forming apparatus according to claim 1, wherein said oscillating voltage comprises a DC voltage and an AC voltage superposed thereon.

5. An image forming apparatus comprising:

an electrostatic image bearing member for bearing an electrostatic image developed by polymer toner;

transfer means for transferring a polymer toner image from said image bearing member onto a transfer material;

electrostatic image forming means for forming an electrostatic image on said electrostatic image bearing member from which residual toner after image transfer operation of transfer means is not removed;

a developing and cleaning means for developing the electrostatic image with polymer toner and collecting residual polymer toner from said image bearing member after image transfer, wherein said developing and cleaning means includes a developer carrying member, faced to said image bearing member, for carrying developer containing polymer toner, and voltage applying means for applying to said developer carrying member an oscillating voltage of a predetermined frequency;

wherein said voltage satisfies:

$$\frac{|Vpp-2V\text{back}|}{16\,Vf^2} < \frac{d^2}{|Q|} \text{ and } Vpp/d > 1 \times 10^6\ (V/m)$$

and wherein:

Vpp [V]: a peak-to-peak voltage of the oscillating voltage

Vf [Hz]: a frequency of the oscillating voltage

Vback [V]: a potential difference between a surface potential of said electrostatic image bearing member and DC component of the oscillating voltage Q [c/kg]: an average amount of polymer toner charge d [m]: a shortest distance between said electrostatic image bearing member and said developer carrying member.

6. An image forming apparatus according to claim 5, wherein said toner is nonmagnetic.

7. An image forming apparatus according to claim 5, wherein said developer contains a carrier, and said developer carrying member comprises a magnetic field generating member disposed therein to generate a magnetic field.

8. An image forming apparatus according to claim 5, wherein said oscillating voltage comprises a DC voltage and an AC voltage superposed thereon.

9. An image forming apparatus comprising developed by toner:

an electrostatic image bearing member for bearing an electrostatic image;

transfer means for transferring a toner image from said image bearing member onto a transfer material;

a developing and cleaning means for developing the electrostatic image with toner and collecting residual toner from said image bearing member after image transfer, wherein said developing and cleaning means including a developer carrying member, faced to said image bearing member, for carrying developer containing toner, and voltage applying means for applying to said developer carrying member an oscillating voltage of a predetermined frequency, which voltage has an AC component interrupted from a duration of a cycle for every predetermined number of cycles;

wherein said voltage satisfies:

$$\frac{S(S+2\alpha)|(1-S)Vpp-Vback|}{2Vf^2} < \frac{d^2}{|Q|}$$

and $$(SVpp+\text{Vback})/d > 1\times10^6\ (V/m)$$

and wherein:

Vpp [V]: a peak-to-peak voltage of the oscillating voltage

Vf [Hz]: a frequency of the oscillating voltage

Vback [V]: a potential difference between a surface potential of said electrostatic image bearing member and DC component of the oscillating voltage Q [c/kg]: an average amount of toner charge d [m]: a shortest distance between said electrostatic image bearing member and said developer carrying member S: a temporal ratio per cycle of the oscillating voltage at which oscillating voltage is applied in the direction of transferring developer onto electrostatic image bearing member ($0<S<1$)

$\alpha$: number of period of AC component interruption per cycle of the oscillating voltage ($0 \leqq \alpha$).

10. An image forming apparatus according to claim 9, wherein said toner is nonmagnetic.

11. An image forming apparatus according to claim 9, wherein said developer contains a carrier, and said developer carrying member comprises a magnetic field generating member disposed therein to generate a magnetic field.

12. An image forming apparatus according to claim 9, wherein said oscillating voltage comprises a DC voltage and an AC voltage superposed thereon.

13. An image forming apparatus according to claim 12, wherein said oscillating voltage has a rectangular waveform.

14. An image forming apparatus according to claim 9, wherein said oscillating voltage is such an oscillating voltage that comprises a portion for moving the developer to said electrostatic image bearing member, and a portion for moving the developer to said developer carrying member.

15. An image forming apparatus comprising:

an electrostatic image bearing member for bearing an electrostatic image developed by polymer toner;

transfer means for transferring a polymer toner image from said image bearing member onto a transfer material;

a developing and cleaning means for developing the electrostatic image with polymer toner and collecting residual polymer toner from said image bearing member after image transfer, wherein said developing and cleaning means includes a developer carrying member, faced to said image bearing member, for carrying developer containing polymer toner, and voltage applying means for applying to said developer carrying member an oscillating voltage of a predetermined frequency, which voltage has an AC component interrupted from a duration of a cycle for every predetermined number of cycles;

wherein said voltage satisfies:

$$\frac{S(S+2\alpha)|(1-S)Vpp-Vback|}{2Vf^2} < \frac{d^2}{|Q|}$$

and $$(SVpp+Vback)/d>5\times10^5\ (V/m)$$

and wherein:

Vpp [V]: a peak-to-peak voltage of the oscillating voltage

Vf [Hz]: a frequency of the oscillating voltage

Vback [V]: a potential difference between a surface potential of said electrostatic image bearing member and DC component of the oscillating voltage Q [c/kg]: an average amount of toner charge d [m]: a shortest distance between said electrostatic image bearing member and said developer carrying member S: a temporal ratio per cycle of the oscillating voltage at which oscillating voltage is applied in the direction of transferring developer onto electrostatic image bearing member ($0<S<1$)

$\alpha$: number of period of AC component interruption per cycle of alternating voltage ($0 \leqq \alpha$).

16. An image forming apparatus according to claim 15, wherein said toner is nonmagnetic.

17. An image forming apparatus according to claim 15, wherein said developer contains a carrier, and said developer carrying member comprises a magnetic field generating member disposed therein to generate a magnetic field.

18. An image forming apparatus according to claim 15, wherein said oscillating voltage comprises a DC voltage and an AC voltage superposed thereon.

19. An image forming apparatus according to claim 15, wherein said oscillating voltage is an oscillating voltage such that comprises a portion which works in the direction of moving the developer to said electrostatic image bearing member, and a portion which works in the direction of moving the developer to said developer carrying member.

20. An image forming apparatus according to claim 15, wherein said oscillating voltage has a rectangular waveform.

* * * * *

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 1,
Line 8, "particular to" should read --particular, to--;
Line 17, "an" (first occurrence) should read --and--; and
Line 51, "thereby" (second occurrence) should be deleted.

COLUMN 2,
Line 31, "above mentioned" should read --above-mentioned--;
Line 50, "container" should read --container.--;
Line 55, "is" should be deleted; and
Line 58, "toner" should read --toner and carrier--.

COLUMN 3,
Line 37, "above described" should read --above-described--.

COLUMN 4,
Line 19, "frequency:" should read --frequency--.

COLUMN 5,
Line 39, "comprising;" should read --comprising:--; and
Line 62, "peak-to-peal" should read --peak-to-peak--.

COLUMN 6,
Line 34, "a" should be deleted, and "drawing" should read --drawings--.

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 8,
Line 60, "ill" should read --in--.

COLUMN 9,
Line 23, "depicts" should read --depict--, and "works" should read --work--; and
Line 45, "developing" should read --developing sleeve--.

COLUMN 13,
Line 35, "$V_{pp}/d>2x10^8(V/m)$" should read --$V_{pp}/d>2x10^6(V/m)$--.

COLUMN 15,
Table 6, "$1.3x10^{-3}$" should read --$1.3x10^{-5}$--; and
Line 64, "$V_{pp}/d>1x10^5(V/m)$" should read --$V_{pp}/d>1x10^6(V/m)$--.

COLUMN 16,
Line 41, "as-the" should read --as the--.

COLUMN 17,
Table 10, "$2.7x10^{-5}<$" should read --$2.7x10^{-5}>$--.

COLUMN 19,
Line 10, "$V_{pp}/d>2x10^8(V/m)$" should read --$V_{pp}/d>2x10^6(V/m)$--.

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 20,
Line 4, close up the left margin; and
Table 12, "$1.1x10^{-5}$>" should read --$1.1x10^{-4}$>--.

COLUMN 24,
Table 17, "$2.7x10^{-6}$<" should read --$2.7 x 10^{-6}$<--
Table 18, "$2.1x10^{4}$" should read --$2.1x10^{6}$--, and
"$3.0x10^{-3}$>" should read --$3.0x10^{-5}$>--; and
Table 19, "$2.2x10^{4}$" should read --$2.2x10^{6}$--,
and "$8.3x10^{-4}$" (both occurrences)
should read --$8.3x10^{-6}$--.

COLUMN 25,
Line 6, P" should read --B--.

COLUMN 26,
Line 8, "tog" should read --fog--;
Line 15, "cleaner less" should read --cleanerless--;
Line 43, "peak-to-peat" should read --peak-to-peak--; and
Table 20, "$1.2x10^{-6}$>" should read --$1.2x10^{-4}$>--, and
"$V_{pp}$=3000" should read --$V_{pp}$=2000--.

COLUMN 33,
Table 30, "$2.1x10^{-3}$" should read --$2.1x10^{-5}$--.

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 34,
Line 61, "X+is" should read --X+ is--.

COLUMN 37,
Line 35, "$(S \cdot V_{pp}+Vback)/d>1x10^8(V/m)$" should read --$(S \cdot V_{pp}+Vback)/d>1x10^6(V/m)$--.

COLUMN 40,
Line 58, "interruptions" should read --interruption,--; and
Line 63, "voltage" should read --voltage and--.

COLUMN 42,
Line 24, "radio" should read --ratio--.
Table 37, "$\frac{S(S+2r)|(1-S)V_{pp}-Vback|}{2Vf2^2}$" should read --$\frac{S(S+2a)|(1-S)V_{pp}-Vback|}{2Vf^2}$--

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 44,
Table 38, "$\frac{S(S+2e)|(1-S)V_{pp}-Vback|}{SVr^2}$" should read

--$\frac{S(S+2a)|1-S)V_{pp}-Vback|}{2Vf^2}$--; and

"$3.0x10^{-6}$>" should read --$3.0x10^{-5}$>--.

COLUMN 45,
Line 7, "$(S \cdot V_{pp}+Vback)/d>5.0x10^5(V/m)$" should read --$(S \cdot V_{pp}+Vback)/d>5.0x10^6(V/m)$--; and
Line 10, "this" should read --and this--.

COLUMN 46,
Lines 37, "comprising developed by toner:" should read --comprising:--

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 48,
Line 39, "that comprises" should read --that it comprises--.

Signed and Sealed this

Fifth Day of October, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,805,960

DATED : September 8, 1998

INVENTOR(S) : HIROYUKI SUZUKI, ET AL.

It is certified that error appears in the above-identified patent and that said Letters Patent is hereby corrected as shown below:

COLUMN 24,

Table 19,"$6.6x10^{-4}$ < " should read --$6.6x10^{-6}$ < --.

Signed and Sealed this

Twenty-fifth Day of April, 2000

*Attest:*

Q. TODD DICKINSON

*Attesting Officer*

*Director of Patents and Trademarks*